US010316663B2

(12) United States Patent
Kennedy et al.

(10) Patent No.: US 10,316,663 B2
(45) Date of Patent: Jun. 11, 2019

(54) MINE DOOR

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 90 days.

(21) Appl. No.: 15/291,731

(22) Filed: Oct. 12, 2016

(65) Prior Publication Data

US 2017/0107817 A1 Apr. 20, 2017

Related U.S. Application Data

(60) Provisional application No. 62/243,683, filed on Oct. 20, 2015.

(51) Int. Cl.

| | |
|---|---|
| ***E06B 3/00*** | (2006.01) |
| ***E21F 1/10*** | (2006.01) |
| *E06B 5/10* | (2006.01) |
| *E06B 3/12* | (2006.01) |

(52) U.S. Cl.

CPC ..... *E21F 1/10* (2013.01); *E06B 3/12* (2013.01); *E06B 5/10* (2013.01)

(58) Field of Classification Search

CPC ..... E21F 1/10; E21F 17/12; E06B 7/2309; E06B 5/10

USPC ..... 49/501

See application file for complete search history.

(56) References Cited

U.S. PATENT DOCUMENTS

| | | | | | |
|---|---|---|---|---|---|
| 1,056,072 | A | * | 3/1913 | Vogan | B21D 13/02 428/604 |
| 1,315,537 | A | * | 9/1919 | Barrows | 105/280 |
| 1,560,526 | A | * | 11/1925 | Barrows | E06B 3/76 16/96 R |
| 1,689,472 | A | * | 10/1928 | Barrows | B61D 19/001 49/501 |
| 2,004,199 | A | | 6/1935 | Gallagher | |
| 2,045,291 | A | * | 6/1936 | Busse | B61D 19/001 105/378 |

(Continued)

FOREIGN PATENT DOCUMENTS

| | | | | |
|---|---|---|---|---|
| CA | 2348589 | A1 * | 4/1999 | H05K 9/0015 |
| CN | 102700616 | A | 10/2012 | |
| CN | 103769458 | A | 5/2014 | |

OTHER PUBLICATIONS

Prior art described in paragraph [0005] of Kennedy U.S. Appl. No. 15/291,731, filed Oct. 12, 2016.

*Primary Examiner* — Jerry E Redman

(74) *Attorney, Agent, or Firm* — Stinson Leonard Street LLP

(57) ABSTRACT

A reinforced lightweight mine door for installation in a mine passageway. The mine door includes a generally rectangular sheet metal door panel having four sides and four corners, and a reinforcing structure projecting from a face of the door panel. The reinforcing structure has a central section and a plurality of channel sections extending from the central section toward respective sides or corners of the door panel. A mine door including at least one hinge arrangement having unique reversibility features is also disclosed.

20 Claims, 25 Drawing Sheets

(56) References Cited

U.S. PATENT DOCUMENTS 2,741,505 A * 4/1956 Courney ..... E05B 63/246 292/128
2,837,183 A 6/1958 Heiman
3,184,263 A * 5/1965 Edouard Plegat Alain ..... B21D 13/02 49/501
3,258,877 A 7/1966 Peras
3,376,120 A * 4/1968 Hiegel Joseph J ..... B21B 39/16 428/582
3,714,739 A * 2/1973 Nolan ..... E06B 5/006 312/324
3,848,324 A 11/1974 Perger
3,968,984 A * 7/1976 Guth ..... A47L 15/4259 292/229
4,011,704 A * 3/1977 O'Konski ..... E04O 3/07 52/481.1
4,074,495 A * 2/1978 Bodnar ..... B21D 13/08 428/603
4,082,331 A * 4/1978 Kennedy ..... E05O 3/14 292/128
4,118,894 A * 10/1978 Kennedy ..... E21F 17/12 49/402
4,133,158 A * 1/1979 Ting ..... E04B 7/107 52/478
4,373,294 A * 2/1983 Kennedy ..... E21F 17/12 292/228
4,478,535 A * 10/1984 Kennedy ..... E21F 17/103 405/132
4,483,642 A * 11/1984 Kennedy ..... E21F 17/103 405/132
4,547,094 A * 10/1985 Kennedy ..... E21F 1/145 405/132
4,751,793 A * 6/1988 Jenkins ..... B61D 19/005 49/501
5,020,295 A * 6/1991 Haines ..... E04D 3/30 52/630
5,063,638 A * 11/1991 Howard ..... E05D 7/0423 16/238
5,168,667 A * 12/1992 Kennedy ..... E05C 3/042 292/204
5,600,868 A * 2/1997 Tourville ..... E05F 1/1223 16/277
5,956,902 A * 9/1999 Cosby ..... E05B 17/0025 49/278
6,032,986 A * 3/2000 Kennedy ..... E05C 3/162 292/196
6,439,666 B1 8/2002 Kimura et al.
7,267,505 B2 * 9/2007 Kennedy ..... E21F 17/103 405/132
7,393,025 B2 * 7/2008 Kennedy ..... E05B 63/22 292/219
7,849,640 B2 * 12/2010 Rice ..... E04B 2/7457 33/483
8,251,250 B1 * 8/2012 Simmons ..... B25H 3/02 220/1.5
D745,701 S * 12/2015 Sparks ..... D25/48.3
9,493,301 B2 * 11/2016 James ..... A47B 97/00
D811,626 S * 2/2018 Sparks ..... D25/121
2003/0079423 A1 5/2003 Kennedy et al.
2003/0129937 A1 * 7/2003 Kennedy ..... E21F 1/14 454/169
2007/0079423 A1 4/2007 Flatt
2007/0157435 A1 * 7/2007 Ramsauer ..... E05D 5/023 16/370
2011/0180237 A1 * 7/2011 Hobbins ..... B21D 25/02 165/104.26
2013/0164483 A1 * 6/2013 Cites ..... B32B 17/10036 428/68

* cited by examiner

MINE DOOR

REFERENCE TO RELATED APPLICATIONS

This application claims priority to U.S. Provisional Application No. 62/243,683, filed Oct. 20, 2015, the entire contents of which is hereby incorporated by reference.

FIELD OF THE INVENTION

The present invention generally relates to mine ventilation equipment, and more particularly to an improved mine door.

BACKGROUND OF THE INVENTION

Stoppings are used to control the flow of ventilation air through a mine. A stopping often includes an opening closed by a door to allow passage through the stopping, as described for example in our U.S. Pat. No. 7,393,025 incorporated herein by reference. Mine doors of this type, sold by Jack Kennedy Metal Products & Buildings, Inc., have proven to be commercially successful. These doors, sometimes referred to as "man doors", are made from relatively thick sheet metal (e.g., 14 gauge metal) to provide the necessary strength. However, the additional bulk increases the expense of the door. There is a need, therefore, for a mine door which is lighter in weight and yet still very strong.

Also, some mine ventilation systems involve reversing air flow through the mine. That is, a mine passage that is an air intake at certain times later becomes an air return. Because it is advantageous for a mine door to be hung on its door frame such that the high pressure pushes the door closed against the frame to aid in both closing and sealing, it is also advantageous that the door be "reversible", that it, the capability of being moved from one side of the door frame to the other at the time of air reversal. Further, it is desirable that the door be self-closing so that it cannot be left open inadvertently.

Heretofore, reversibility has been achieved in some cases by unfastening the hinges of the mine door from one side of the door frame and re-fastening the hinges to the opposite side of the door frame. This procedure is labor-intensive and time-consuming. In other cases, the door mounts on open topped hinge pins at one side of the door frame such that the door can be lifted off the hinge pins and moved to similar hinge pins on the opposite side of the door frame. However, the door is not self-closing. There is a need, therefore, for a self-closing mine door that can be quickly moved from one side of the door frame to the other.

SUMMARY OF THE INVENTION

This invention involves a mine door assembly which, in one embodiment, comprises a reinforced lightweight mine door for installation in a mine passageway. The mine door comprises a generally rectangular sheet metal door panel having four sides and four corners, and a reinforcing structure projecting from a face of the door panel. The reinforcing structure comprises a central section and a plurality of channel sections extending from the central section toward respective sides or corners of the door panel.

In another embodiment, this invention involves a mine door assembly for installation in a mine passageway. The mine door assembly comprises a mine door frame having a first side facing a first direction and a second side facing a second direction opposite the first direction. The assembly also includes a mine door comprising at least one spring-loaded hinge for mounting the mine door on the mine door frame and urging the mine door toward a closed position. The spring-loaded hinge comprises a bracket, at least one first fastener on the mine door frame adjacent the first side of the mine door frame, and at least one second fastener on the mine door frame adjacent the second side of the mine door frame. The bracket of the at least one spring-loaded hinge is configured for releasable connection to the at least one first fastener for selectively mounting the mine door on the mine door frame in a first position at the first side of the mine door frame for opening the door in said first direction, and for releasable connection to the at least one second fastener for selectively mounting the mine door on the mine door frame in a second position at the second side of the mine door frame for opening the door in said second direction.

In another embodiment, this invention involves the mine door described in the preceding paragraph.

In still another embodiment, this invention involves a mine door assembly comprising a mine door frame having a first side adapted to face a first direction and a second side adapted to face a second direction opposite the first direction. The assembly includes a mine door comprising at least one hinge for mounting the mine door on the mine door frame. The hinge comprises at least one bracket having a keyhole slot, at least one first fastener on the mine door frame adjacent the first side of the mine door frame, and at least one second fastener on the mine door frame adjacent the second side of the mine door frame. The keyhole slot is adapted to receive the at least one first fastener for selectively and releasably mounting the mine door in a first position on the mine door frame for opening the door in the first direction, and the keyhole slot is adapted to receive the at least one second fastener for selectively and releasably mounting the mine door in a second position on the mine door frame for opening the door in said second direction.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
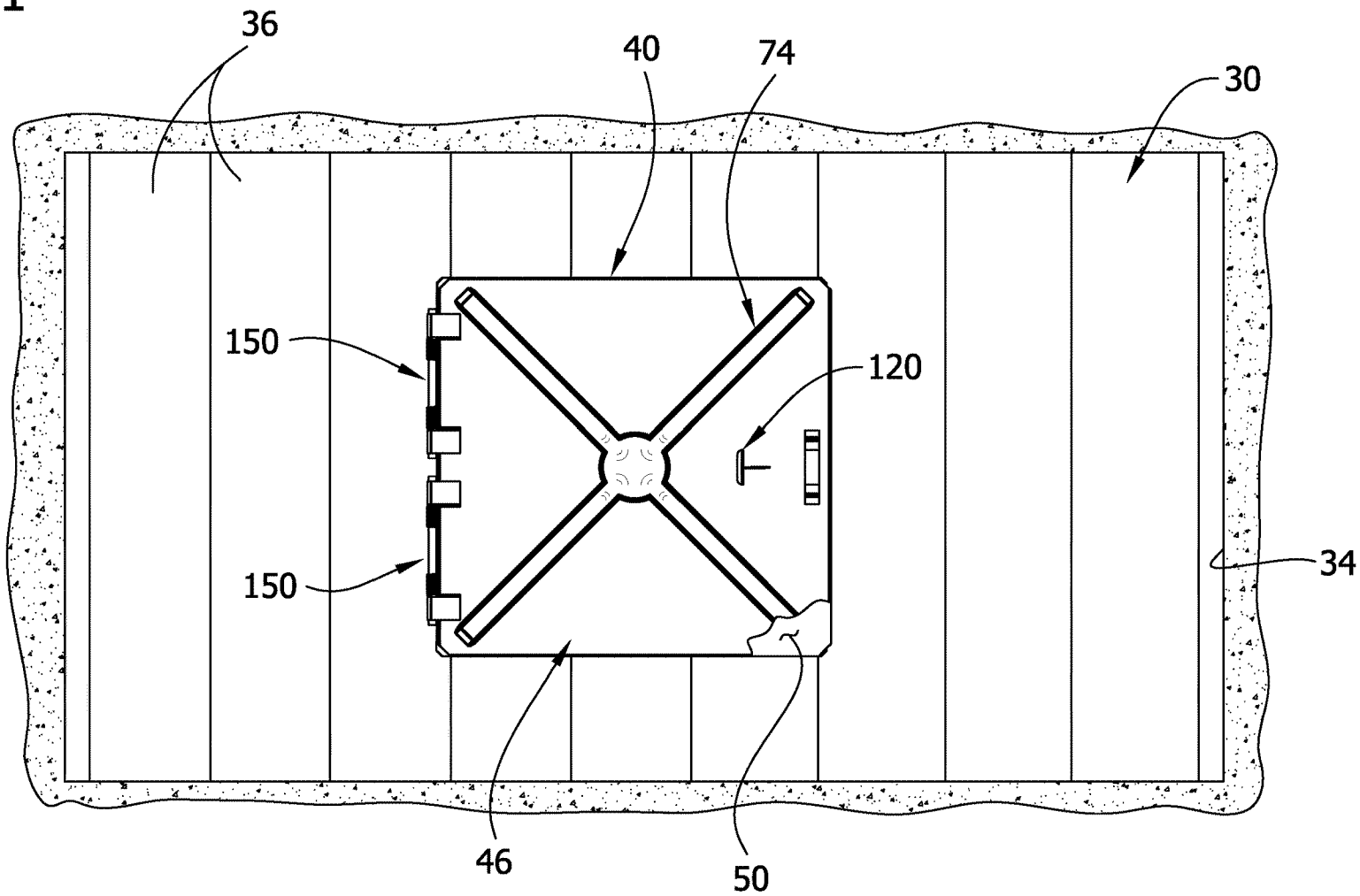
FIG. 1 illustrates a mine door assembly installed in a mine passageway.
Figure 11:
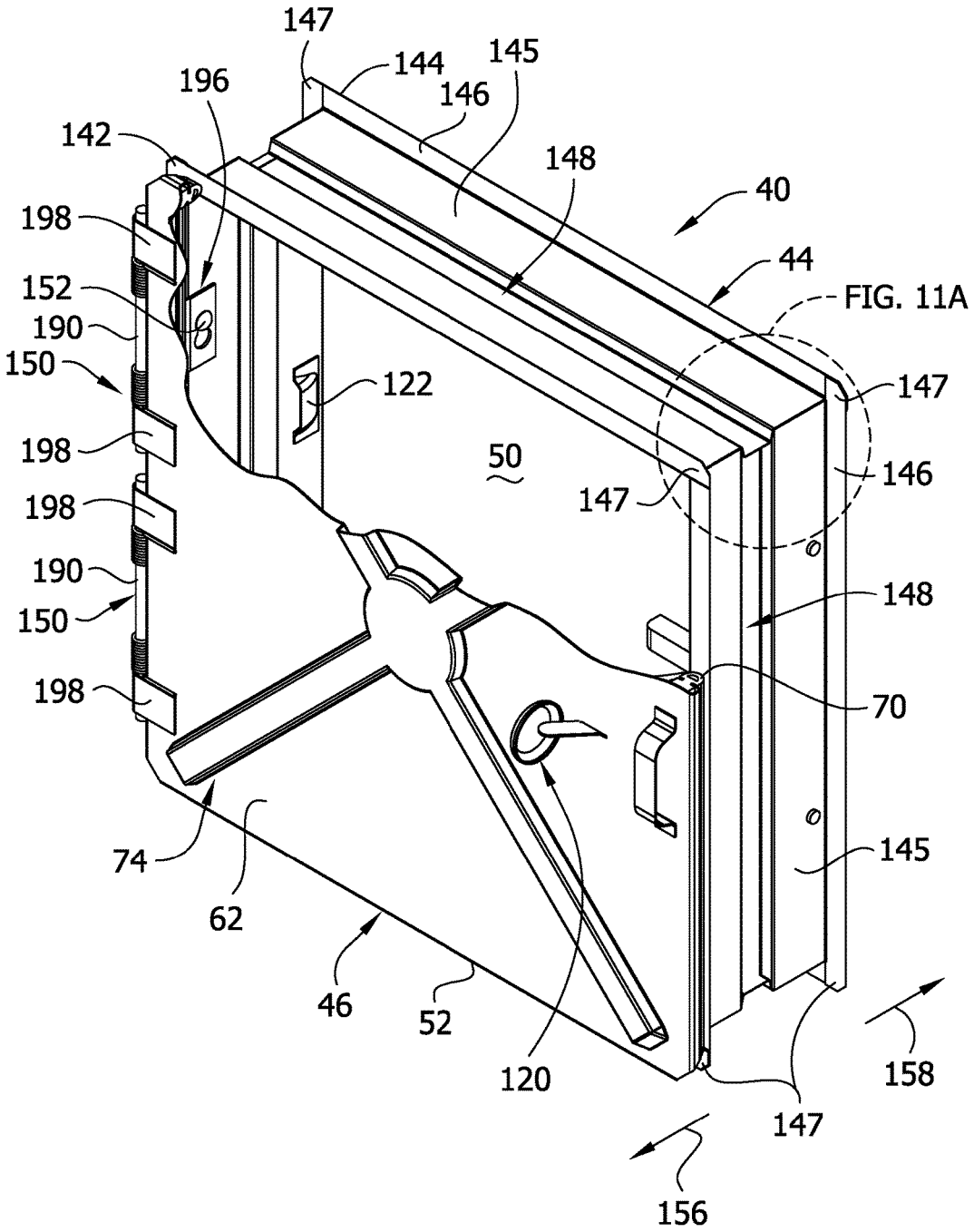
FIG. 11 is a perspective of a mine door assembly having a reversibility feature, a mine door of the assembly being shown in a closed position.

Referring to the drawings, FIG. 1 illustrates a stopping, generally designated 30, installed in a mine passage 34. By way of example but not limitation, the stopping 20 may be made from blocks or a series of elongate panels 36 of the type described in our U.S. Pat. Nos. 4,483,642, 4,547,094, and 7,267,505, all of which are incorporated herein by reference. A mine door assembly, generally designated 40, is secured to the stopping 30. As illustrated in FIG. 11, the mine door assembly 40 includes a door frame generally designated 44 and a mine door generally designated 46 mounted on the door frame for pivotal movement between an open position allowing access through a doorway 50 defined by the door frame and a closed position for closing the doorway. As illustrated in FIG. 1, the mine door pivots about a vertical axis, but it will be understood that it could be configured to pivot about a horizontal axis.

Figure 5:
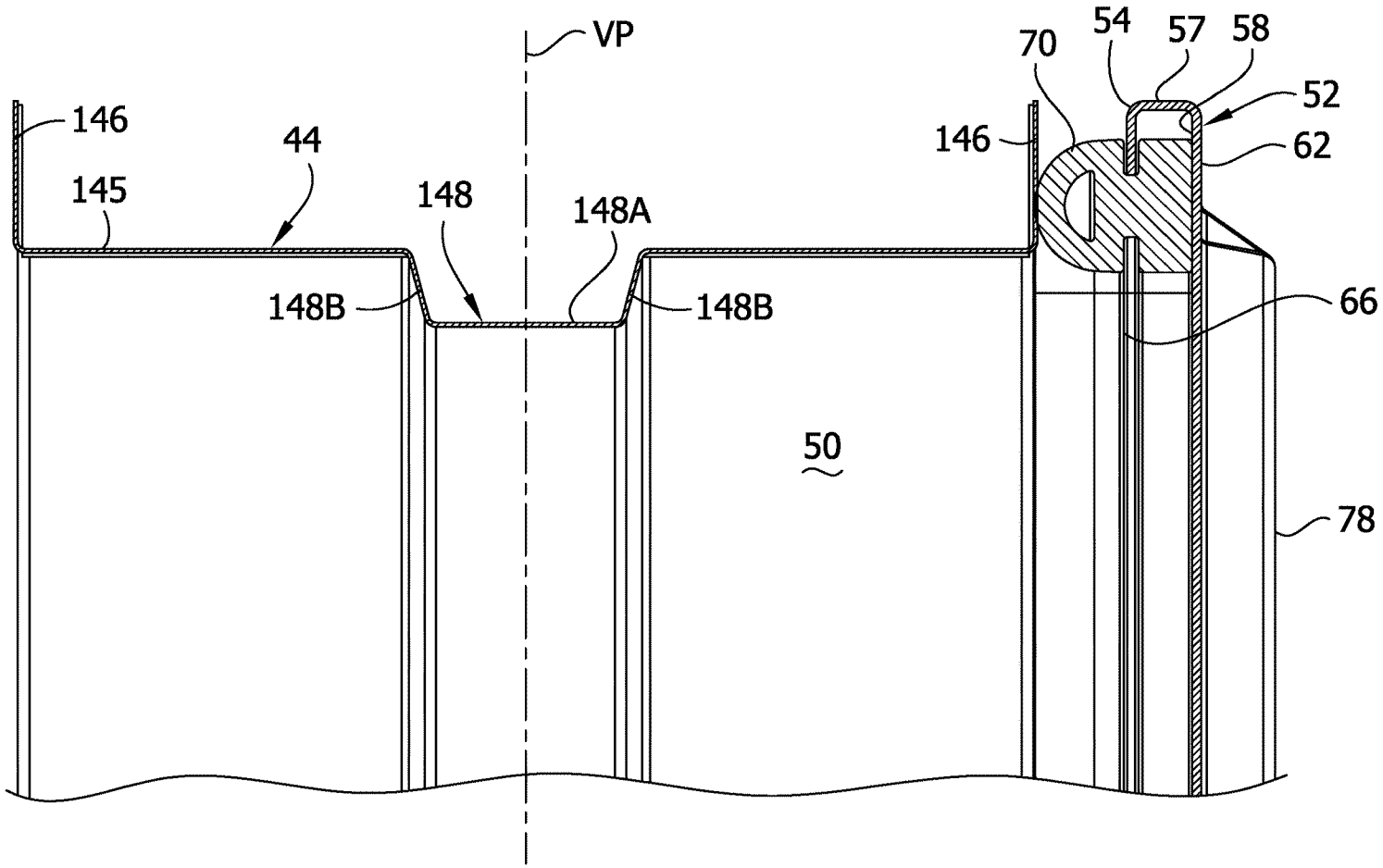
FIG. 5 is a cross-section taken in the plane of 5-5 of FIG. 2.

Referring to FIGS. 2-5, the mine door 46 comprises a generally rectangular (e.g., square) sheet metal door panel 52 having four sides 54, four corners 56, an inner face 58 facing the doorway 50 when the door is closed, and an opposite outer face 62 facing away from the doorway when the door is closed. As illustrated in FIG. 5, flanges 57 project inward from the inner face 58 of the door panel 52 at the four respective sides of the door and cooperate with channels 66 affixed (e.g., welded) to the inner face 58 of the door panel to hold a seal 70 for sealing against the door frame 44 all around the doorway 50 when the door is in its closed position. The sealing arrangement may be as shown in our aforementioned U.S. Pat. No. 7,393,025 incorporated herein by reference.

Figure 5A:
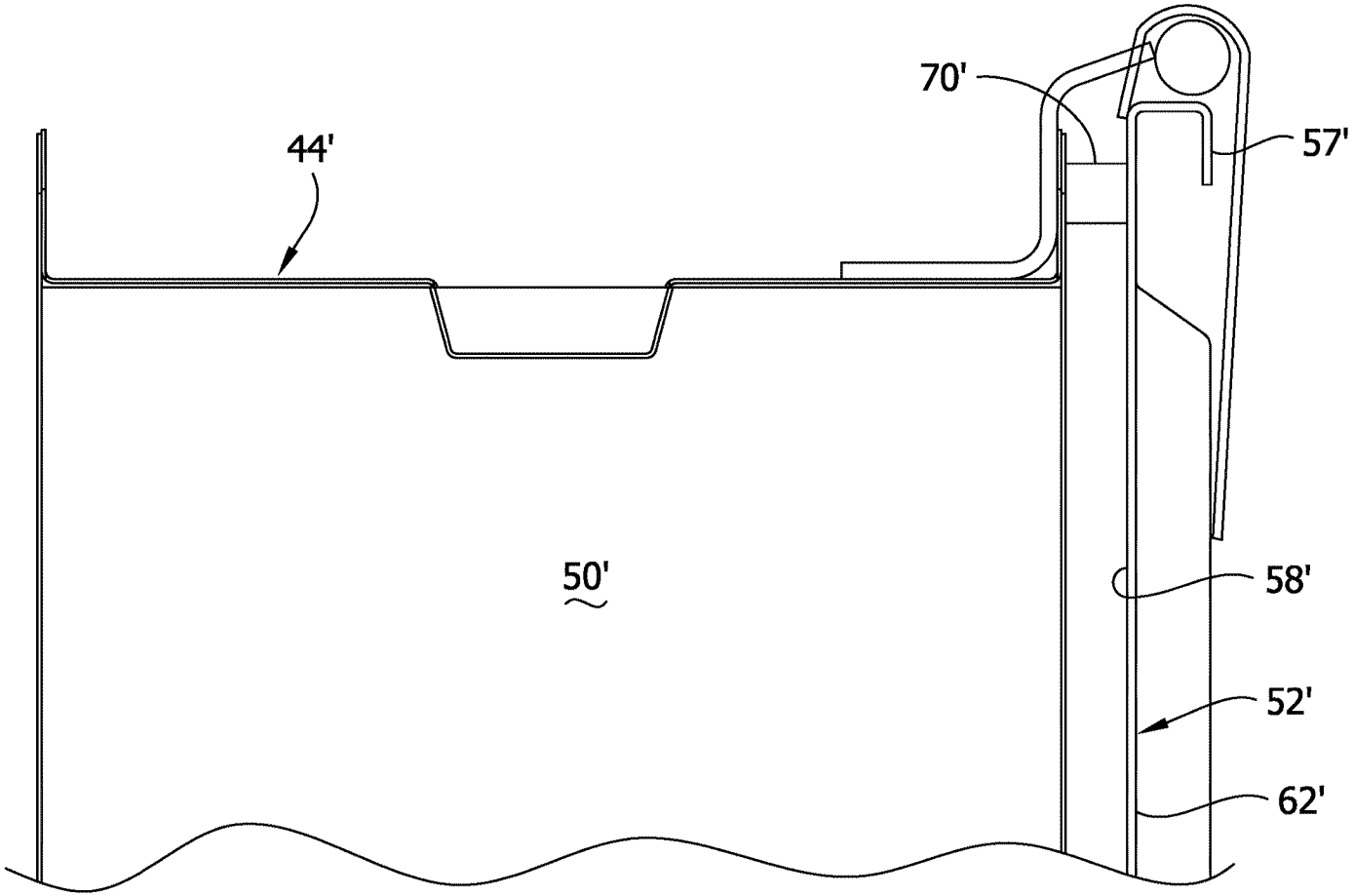
FIG. 5A is a view similar to FIG. 5 but showing an alternative door sealing arrangement.

FIG. 5A illustrates an alternative sealing arrangement, e.g., for smaller doors. The arrangement is similar to that shown in FIG. 5 and corresponding components are designated by corresponding reference numbers with a prime designation (′). In this embodiment, the flanges 57′ of the door project outward from the outer face 62′ of the door panel 52′. The seal 70′ is a seal secured (e.g., glued) to the inner face 58′ of the door panel for engagement with the door frame 44′ all around the doorway 50′ when the door is in its closed position. Other seal configurations may be used.

Figure 2:
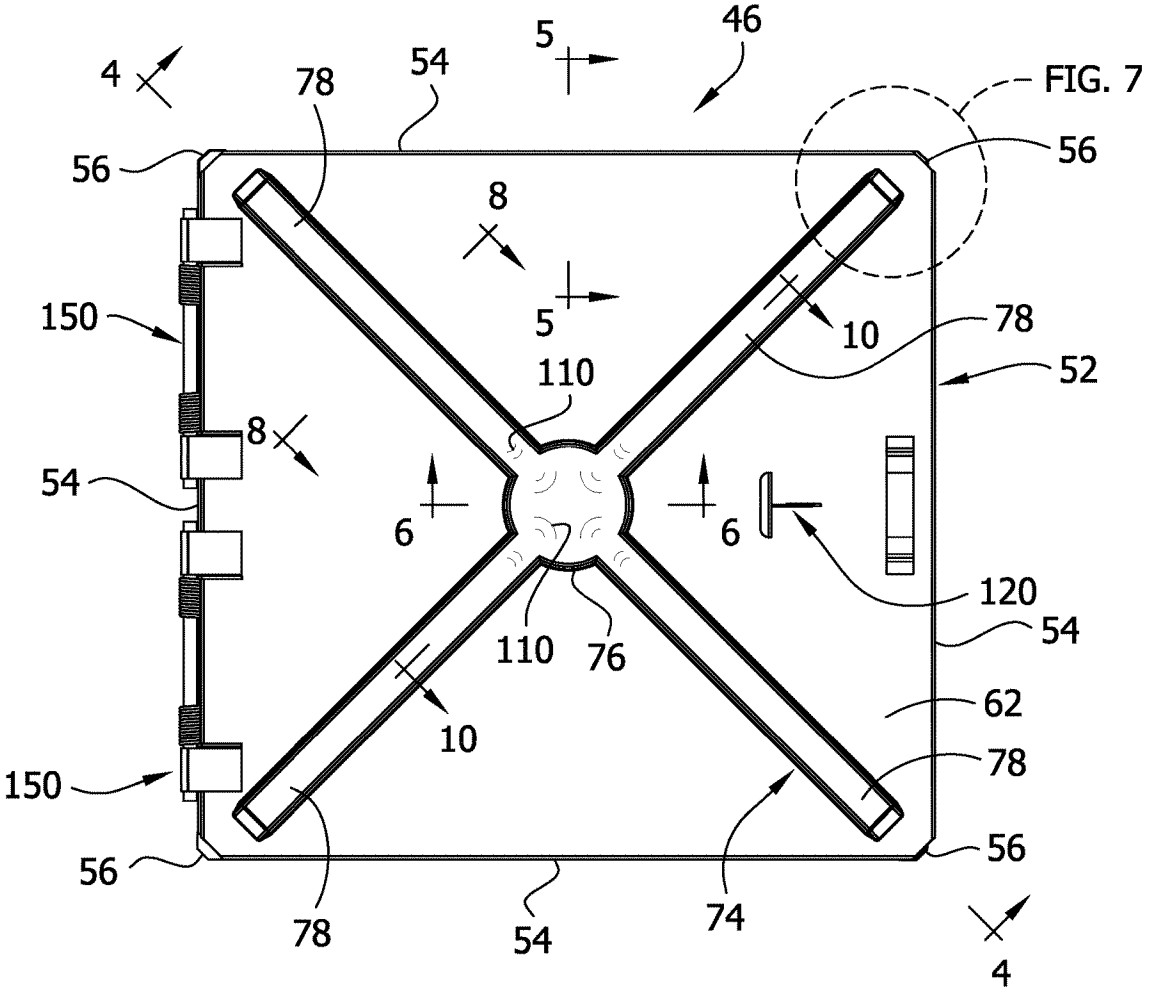
FIG. 2 is a front elevational view of the mine door assembly of FIG. 1.
Figure 3:
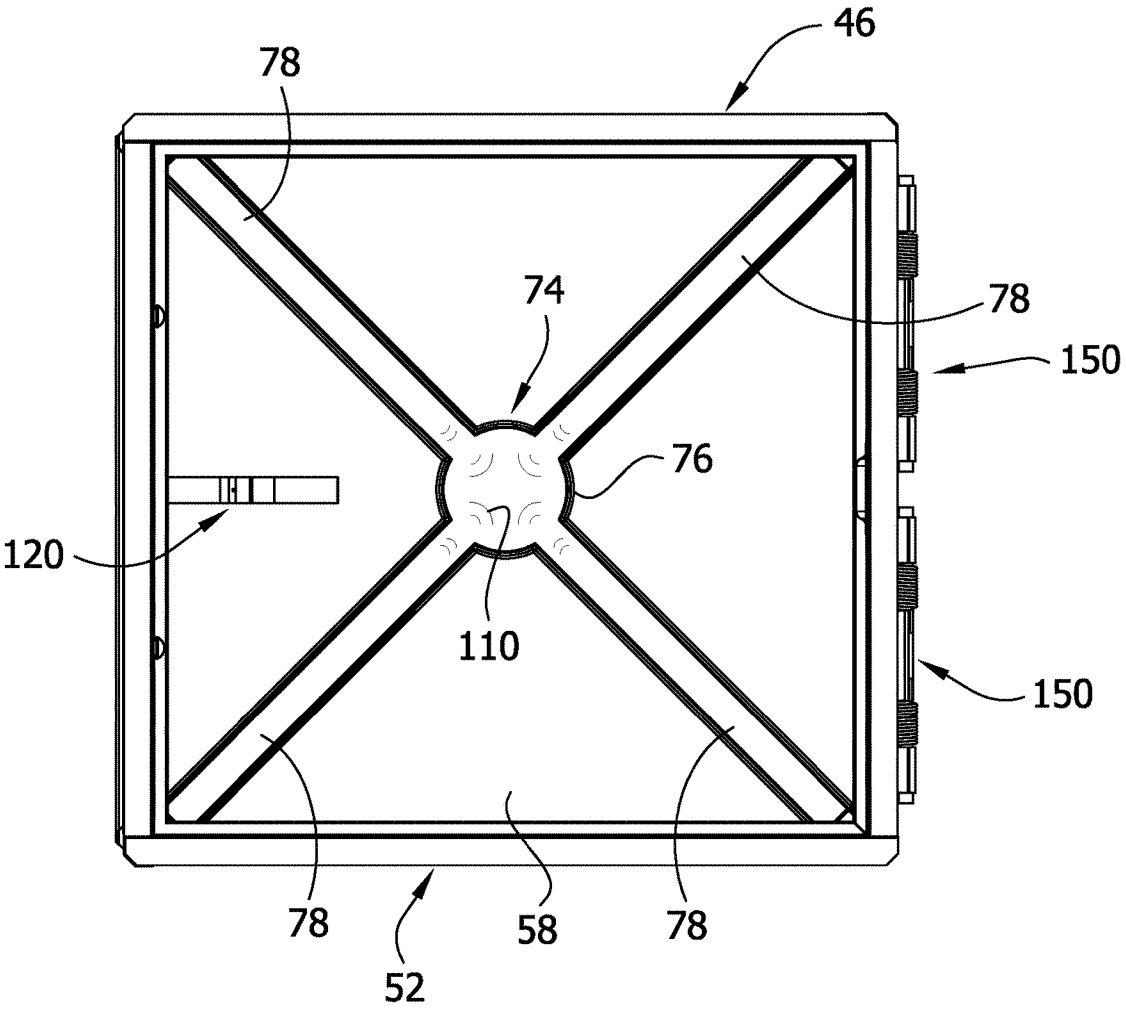
FIG. 3 is a rear elevational view of the mine door assembly of FIG. 1.
Figure 4:
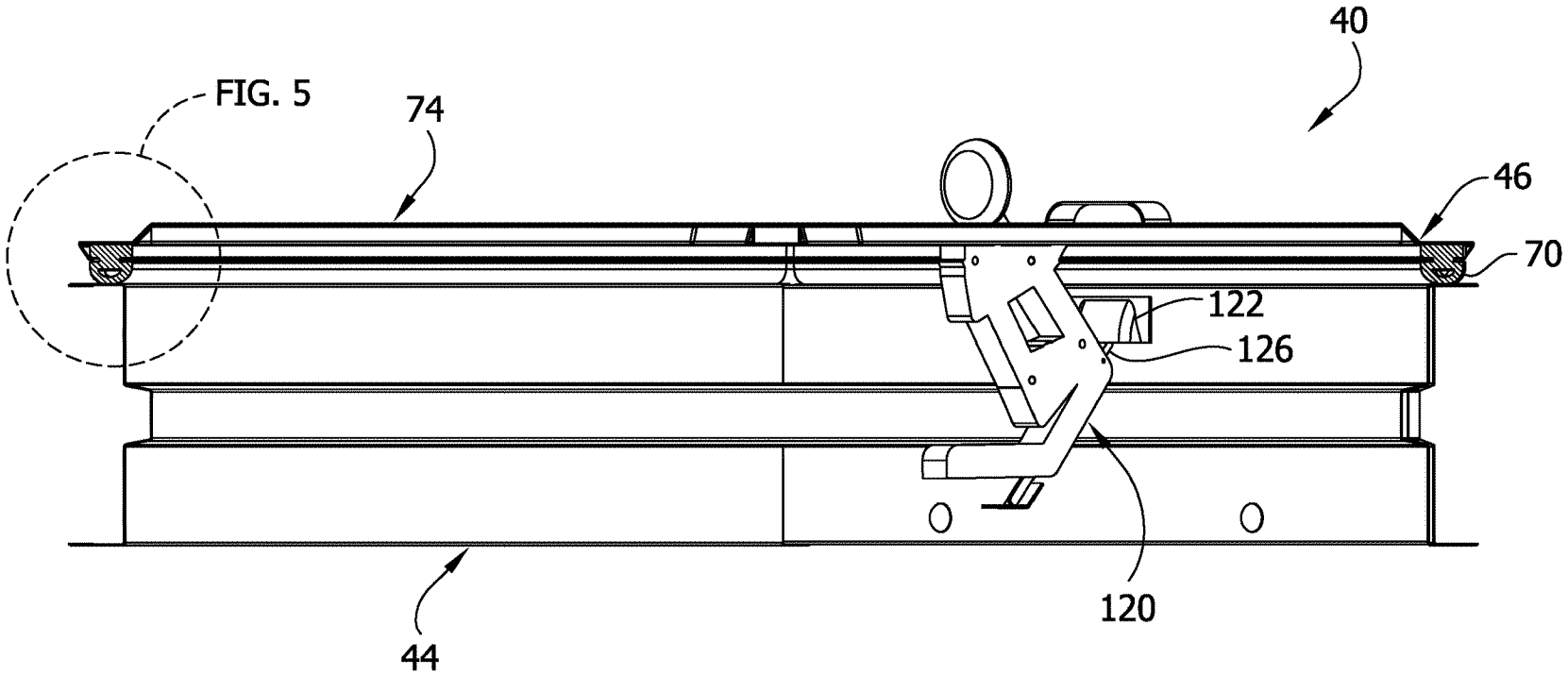
FIG. 4 is a cross-section taken in the plane of 4-4 of FIG. 2.

Referring to FIG. 2, the mine door 46 includes a reinforcing structure, generally designated 74, projecting laterally outward from the outer face 62 of the door panel 52. Alternatively, the reinforcing structure could project laterally inward from the outer face of the door panel. This structure 74 comprises a central section 76 and a plurality of channel sections 78 extending from the central section toward respective sides 54 or corners 56 of the door panel 52. Importantly, the reinforcing structure 74 and door panel 52 are integrally formed, that is, the reinforcing structure is formed as one piece with the sheet metal of the door panel. Alternatively, the reinforcing structure 74 could be formed (e.g., stamped) as a separate piece and then secured (e.g., welded or otherwise fastened) to the door panel 52. As best illustrated in FIG. 11, the mine door 46 lacks a second door panel sandwiching the reinforcing structure 74 between the sheet metal door panel 52 and said second door panel.

In the illustrated embodiment, the reinforcing structure 74 is generally X-shaped and comprises four channel sections 78 extending from the central section 76 toward respective corners 56 of the door panel 52. However, it will be understood that the reinforcing structure can have shapes other than an X-shape. By way of example but not limitation, the reinforcing structure can be generally K-shaped, or generally Y-shaped, or generally H-shaped, or generally cross (+)-shaped, or any other shape where a number of channel sections extend from what can be broadly described as a "central section." As used in this context, the term "central section" is intended to identify the portion of the reinforcing structure from which the channel sections originate; the term is not restricted to a location at the geometric center of the door panel 52.

Figure 6:
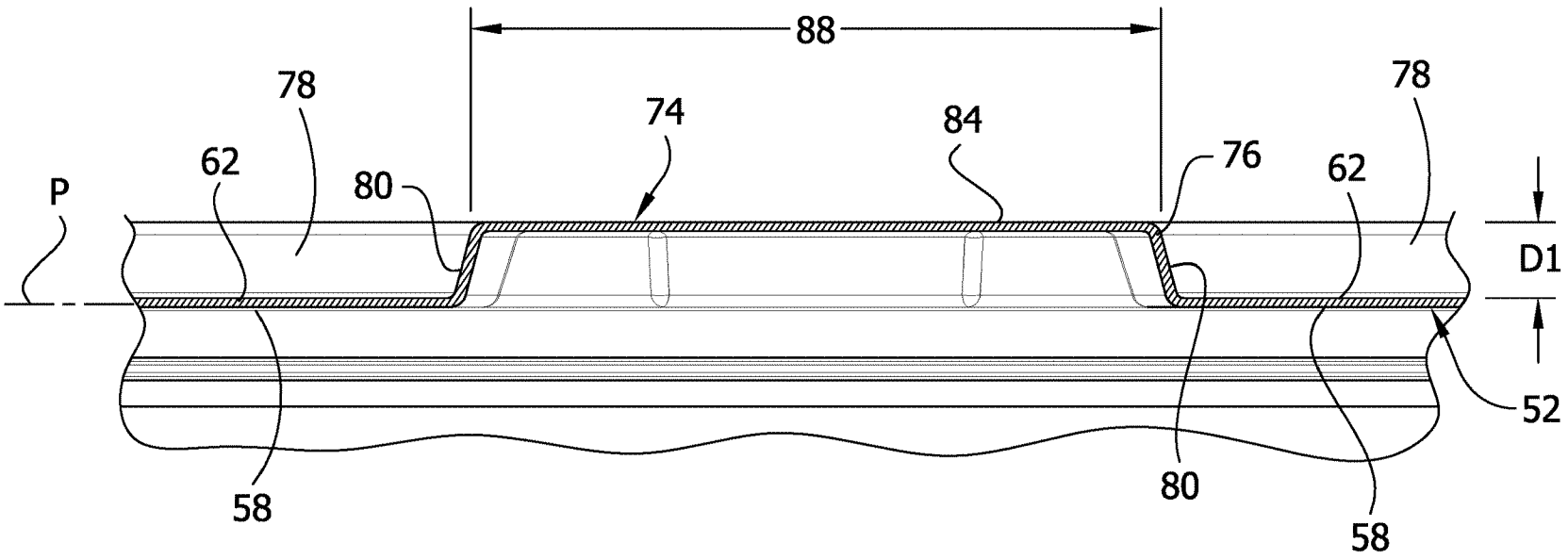
FIG. 6 is a section taken in the plane of 6-6 of FIG. 2.

The central section 76 of the X-shaped reinforcing structure 74 allows the four channel sections 78 to terminate without interfering with one another. In addition, the central section 74 increases the moment of inertia of the door where the stresses on the door, due to the air pressure differential across the door, are both the greatest, and where they are compound. In the illustrated embodiment, the central section 76 is a generally dish-shaped formation comprising a generally circular side wall 80 projecting laterally outward, e.g., substantially at right angles, from the outer face 62 of the door panel 52, and a bottom wall 84 (see FIG. 6). Desirably, the bottom wall 84 is substantially flat, extends generally parallel with the plane P of the door panel 52, and is spaced a first distance D1 from the outer face 62 of the door panel 52. This first distance D1 generally corresponds to the depth of the central section 76. The central section 76 may have shapes other than circular without departing from the scope of this invention. By way of example, if the mine door is elongate, the central section may be oval in shape, with the long axis of the oval extending generally parallel to the long axis of the door. In general, it is desirable that the central section 76 be free of corners that might otherwise create excessive areas of stress.

Figure 7:
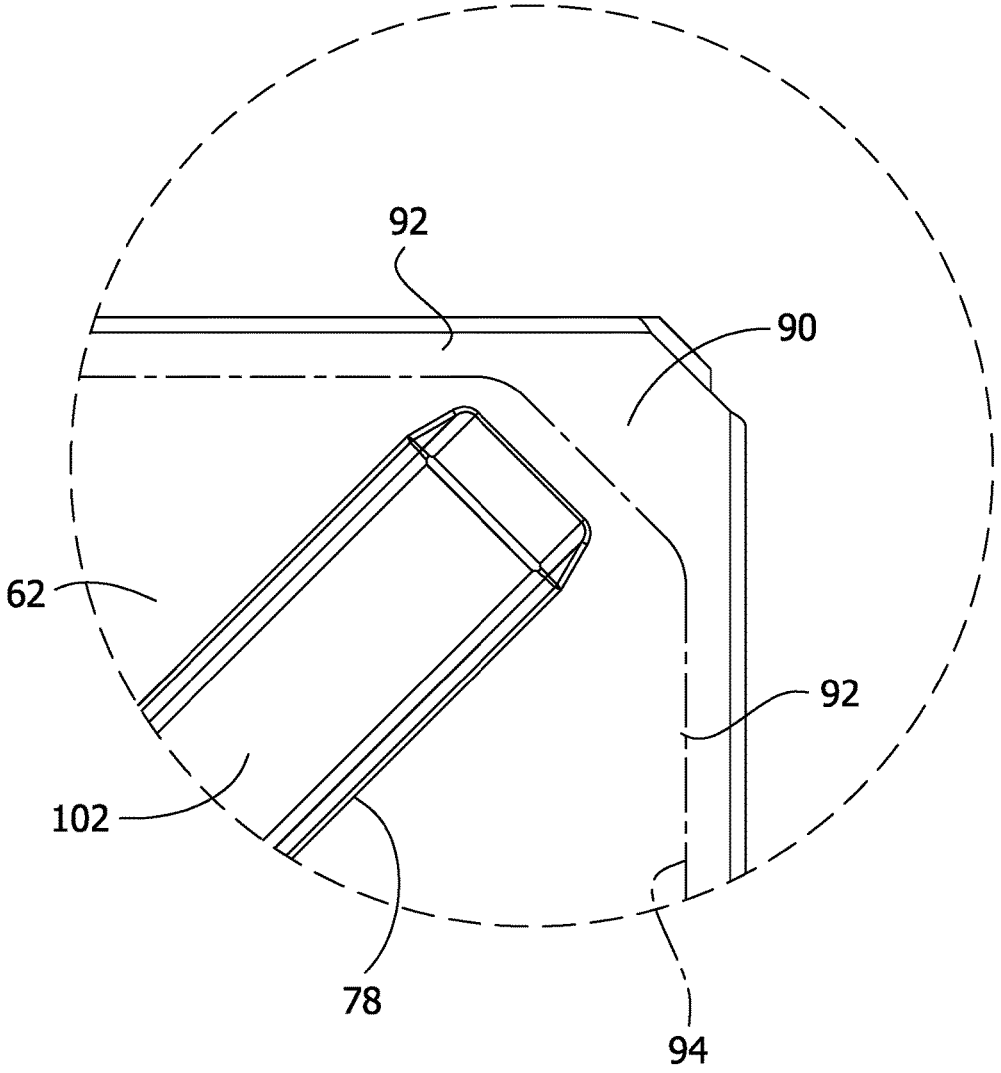
FIG. 7 is an enlarged portion of FIG. 2 showing a corner construction of the door.

Referring to FIGS. 2 and 7, the four channel sections 78 of the reinforcing structure 74 have inner ends intersecting the side wall 80 of the central section 76 at intervals around the central section, e.g., at substantially equal 90-degree intervals. The channel sections 78 also have outer ends terminating short of respective corners 56 of the door panel 52 to provide flat corner sections 90 of the door panel (see FIG. 7). These flat corner sections 90 cooperate with flat side sections 92 of the door panel to provide an unobstructed flat sealing area 94 extending completely around the periphery of the door panel 52 to facilitate mounting the seal 70 on the door panel.

Figure 8:
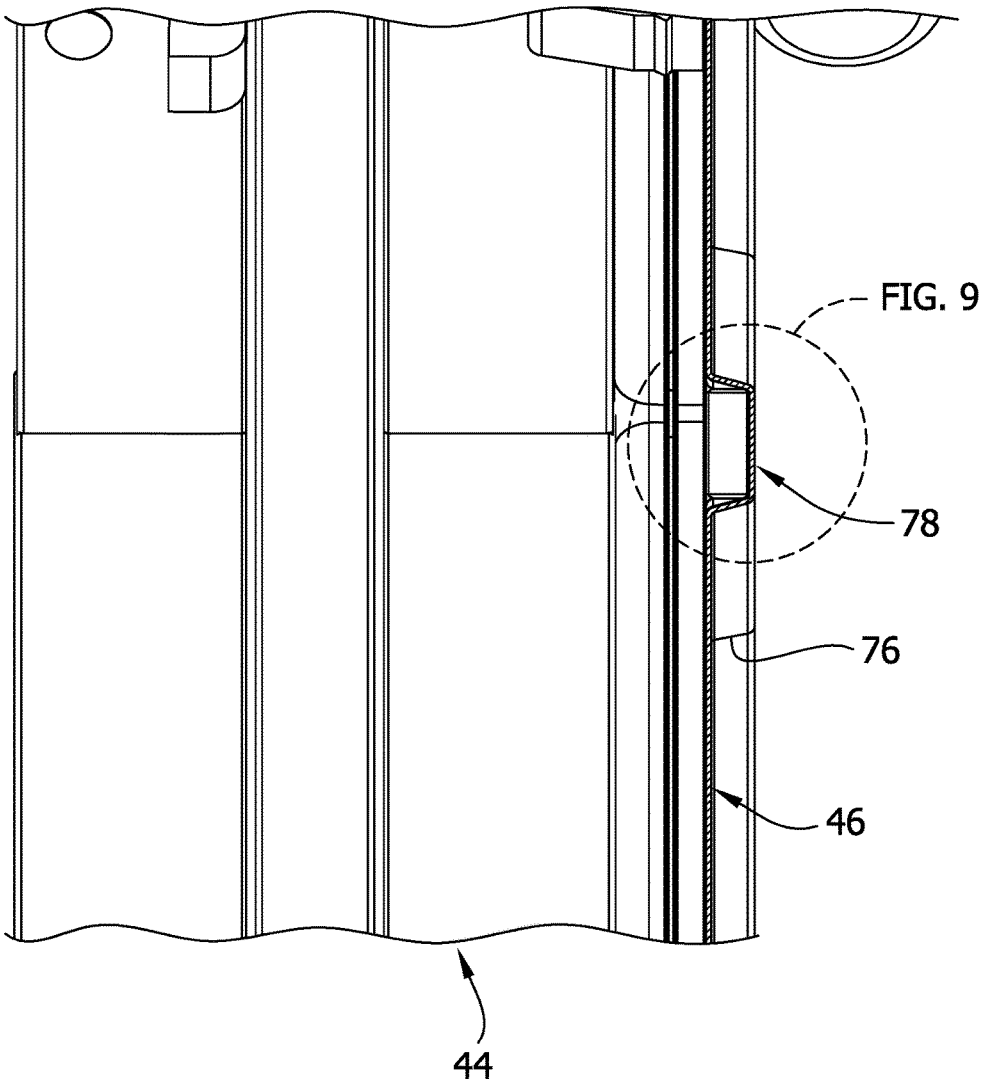
FIG. 8 is a section taken in the plane of 8-8 of FIG. 2.
Figure 9:
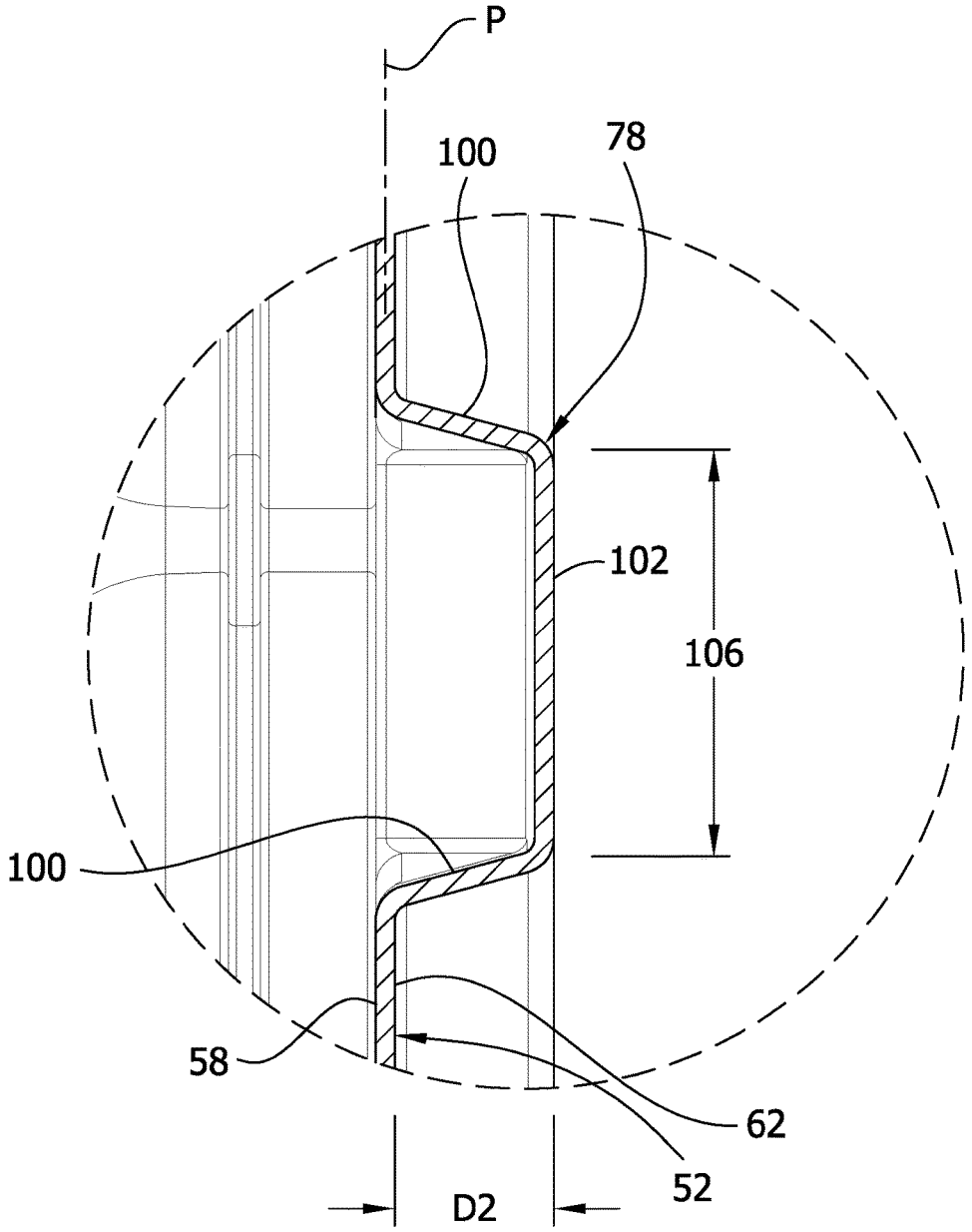
FIG. 9 is an enlarged portion of FIG. 8 showing a channel section of a reinforcement structure on the door.

As best illustrated in FIGS. 8 and 9, each channel section 78 of the reinforcing structure 74 has opposite sides comprising, in this embodiment, two spaced-apart side walls 100 projecting laterally outward, e.g., substantially at right angles, from the outer face 62 of the door panel 52. Each channel section 78 of the embodiment further comprises: a bottom wall 102. Desirably, the bottom wall 102 is substantially flat, extends generally parallel with the plane P of the door panel 52, and is spaced a second distance D2 from the door panel. The second distance D2 generally corresponds to the depth of the channel section. The side walls 100 of each channel section 78 intersect with the side wall 80 of the central section 76. Similarly, the bottom wall 102 of each channel section 78 intersects with the bottom wall 84 of the central section 76. Desirably, at these latter intersections, the bottom walls 102 of the channel sections 78 and the bottom wall 84 of the central section 76 are substantially co-planar. In other embodiments, the bottom walls 102 of the channel sections 78 are not substantially co-planar or parallel with the bottom wall 84 of the central section 76. By way of example, in one embodiment the side walls 100 of the channel sections 78 are tapered so that the depths of the channel sections increase toward the center of the door where the stress is greater. The bottom walls 102 of the channel sections 78 slope inward at their outer ends to join the outer face 62 of the door panel 52.

Desirably, the bottom wall 84 of the central section 76 has a cross-dimension 88 (diameter for a circular shape) substantially greater than a width dimension 106 of each channel section. (Compare FIGS. 6 and 9.) Even more desirably, the cross-dimension 88 is greater than the sum of the width dimensions 106 of the four channel sections. In the illustrated embodiment, the width dimension 106 of each channel section 78 is substantially uniform along substantially the entire length of the channel section (see FIG. 2). In other embodiments, the width dimension 106 may vary along the length of the channel section. By way of example, the width dimension 106 of the channel sections 78 may increase in a direction toward the central section 76 so that the channel sections are generally pie-shaped, pointing toward respective corners 56 of the door panel 52. Increasing both the cross-dimension 88 of the central section 76 and the width dimension 106 of the channel sections 78 creates a more balanced door section, i.e., more equal "flanges" (raised and non-raised areas) of the door panel 52. As a result, the strength of the door is greater. This may be especially important for bigger doors.

In general, it is desirable to maximize the width and depth of each channel section 78 to obtain the greatest increase in strength possible (by increasing the planar area moment of inertia of the door 46) consistent with being able to form the door without tearing or otherwise severely degrading the sheet metal. Desirably, the width dimension 106 of the each channel section 78, as measured across the bottom wall 102, is at least twice the depth of the channel section, i.e., the stated second distance D2. In one embodiment, the first and second distances D1, D2 corresponding to the depths of the central section 76 and the channel sections 78, respectively, are substantially equal.

As previously noted, the door panel 52 and X-shaped reinforcing structure 74 are integrally formed as one piece from sheet metal. The sheet metal has a thickness in the range of about 0.02-0.06 in and a yield strength preferably at least 45,000 psi and even more preferably at least 60,000 psi. Desirably, for smaller doors having dimensions in the range of 24-36"24-36", the thickness is in the range of 0.28-0.47 in, and the yield strength is preferably in the range of 45,000-90,000 psi and even more preferably in the range of 60,000-80,000 psi. (For larger doors, e.g., those having dimensions in the range of 36-60"×36-60", the thickness and/or yield strength are correspondingly greater.) This compares very favorably to prior commercial designs using sheet metal having a thickness in the range of 0.070-0.087 in and a yield strength less than 25,000 psi. Using the X-shaped reinforcing structure 74 allows the use of thinner-gauge metal without sacrificing strength. As a result, the mine door 46 is lightweight (less metal), less expensive, and very strong.

In one embodiment, the door panel 52 and X-shaped reinforcing structure 74 are formed in a pressing operation during which the reinforcing structure is pressed into a planar blank of sheet metal forming the door panel. As the blank is pressed, the sheet metal stretches and draws from the edges of the blank to form the central section 76 and the four channel sections 78, and corrugations 110 (FIG. 2) are formed in the bottom wall 84 of the central section and in the bottom walls 102 of the channel sections generally adjacent intersections of the channel sections and the central section. The side flanges 57 of the door panel 52 may be formed before, during or after the X-shaped reinforcing structure 74 is formed. Desirably, but not necessarily, the flanges 57 are integrally formed from the same blank of sheet metal as the door panel 52 and X-shaped reinforcing structure 74.

Figure 10:
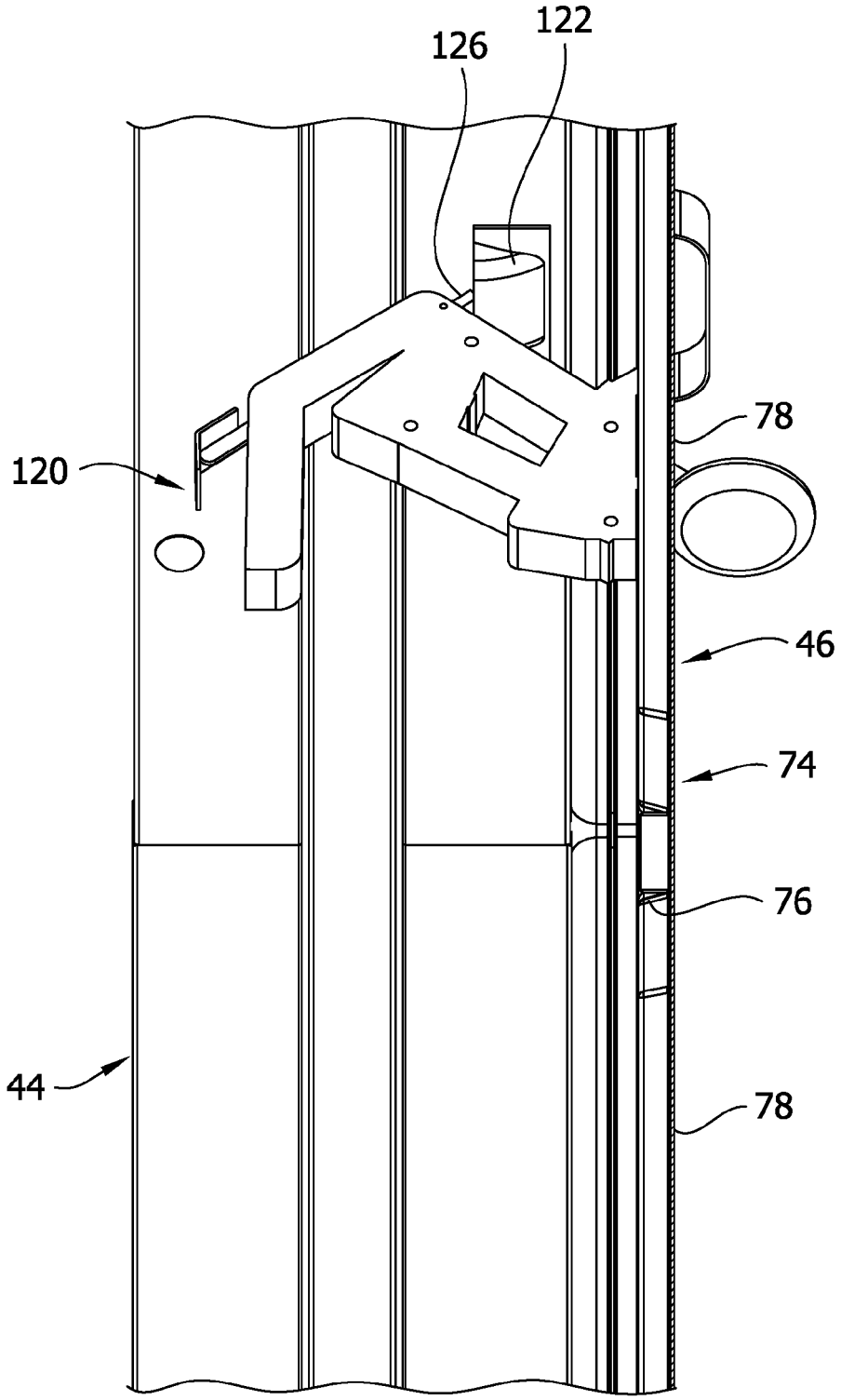
FIG. 10 is a section taken in the plane of 10-10 of FIG. 2.

Referring to FIG. 10, the door assembly 46 also includes a suitable latching assembly, generally designated 120, for latching the mine door 46 in its closed position against the door frame 44. In one embodiment, the latching assembly 120 comprises a latch 122 on the door 46 and a keeper 126 on the door frame 44. By way of example, the latching assembly 120 may be of the type disclosed in our U.S. Pat. No. 7,393,025 incorporated herein by reference. Alternatively, other latching mechanisms may be used without departing from the scope of this invention.

In one embodiment, the mine door is self-closing. That is, the door is spring-biased toward its closed position.

Referring to FIGS. 5, 11, 11A, 11B and 12, the mine door frame 44 is generally rectangular and comprises four frame members 140 surrounding the doorway 50, including generally horizontal top and bottom frame members 140 and generally vertical left and right frame members 140. The frame 44 has a first (front) side 142 lying generally in a first plane P1 defined by a front face of the frame and a second opposite (back) side 144 lying in a second plane P2 defined by a back face of the frame. The planes P1, P2 are spaced apart a distance corresponding to the depth of the door frame 44 and lie at opposite ends of the doorway 50 through the frame. The frame 44 may be constructed substantially as described in our U.S. Pat. No. 7,393,025 incorporated herein by reference. In one embodiment, each of the four frame members 140 is generally channel-shaped and comprises a web 145 and flanges 146 at opposite sides of the web. Alternatively, the frame member 140 has only one flange 146, namely, the flange at the side of the frame adjacent the mine door 46. Desirably, the frame members 140 are fabricated (e.g., stamped) as four separate pieces of sheet metal and then secured together, as by welding overlapping portions of the flanges 144 at locations 147 at the corners of the frame (see FIG. 11). For additional strength, at least the top and side frame members, and preferably all four of the frame members, are formed (e.g., stamped) with ribs 148 extending along the webs 145 of the frame members 140 (see FIG. 5). Desirably, the ribs 148 project inward toward the center of the door opening and extend along the full lengths of the webs 145 of respective frame members to form a substantially continuous reinforcement around the entire perimeter of the frame 44. In the illustrated embodiment (see FIG. 5)

each rib 148 is generally channel-shaped and comprises a bottom wall 148A and side walls 148B. Further, the ribs 148 lie in and are symmetrical about the central vertical plane VP of the frame. However, the ribs may have other shapes and other locations. Also, each frame member 140 may have more than one reinforcing rib.

Figure 11A:
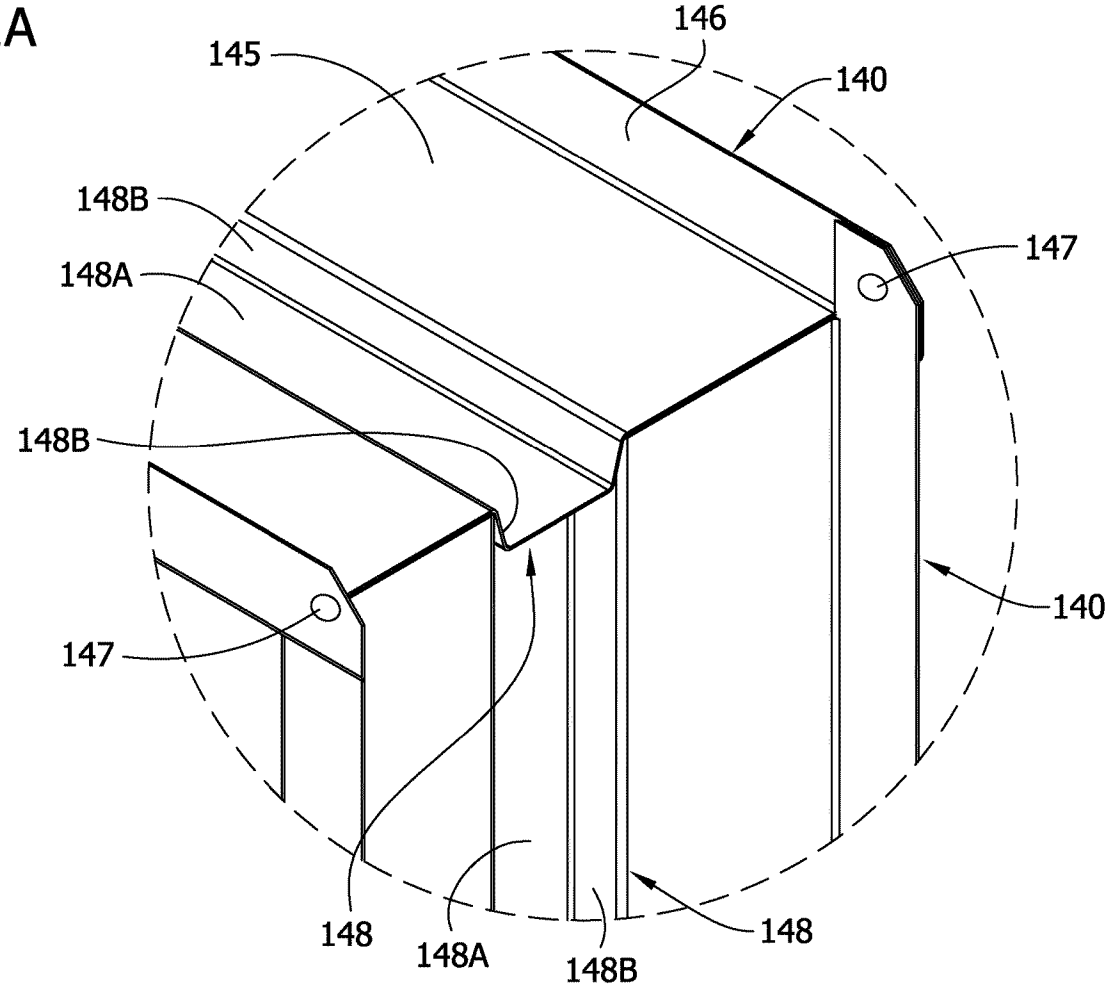
FIG. 11A is an enlarged portion of FIG. 11 showing a corner construction of the assembly.
Figure 11B:
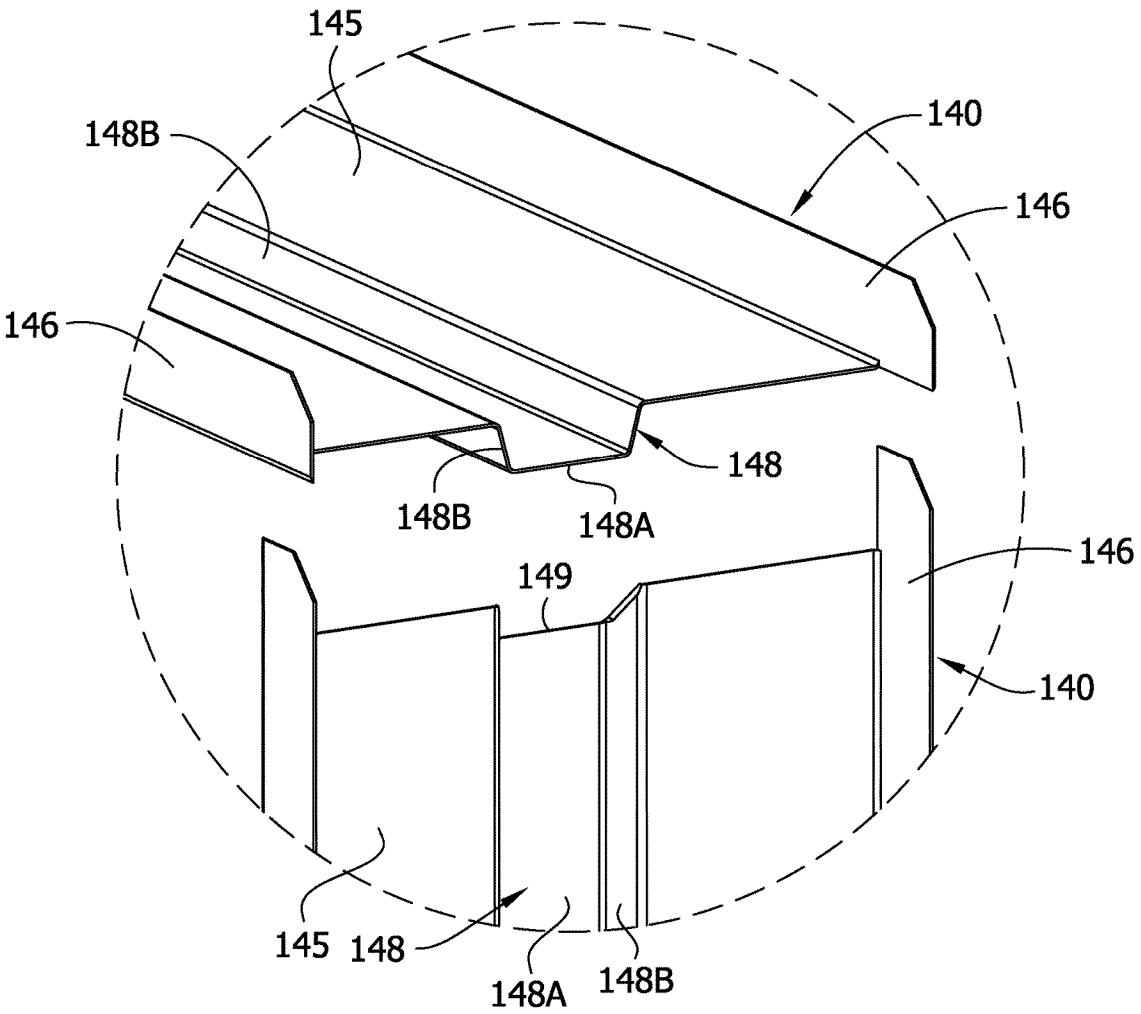
FIG. 11B is an exploded view of components of a door frame of the assembly of FIGS. 11 and 11A.
Figure 12:
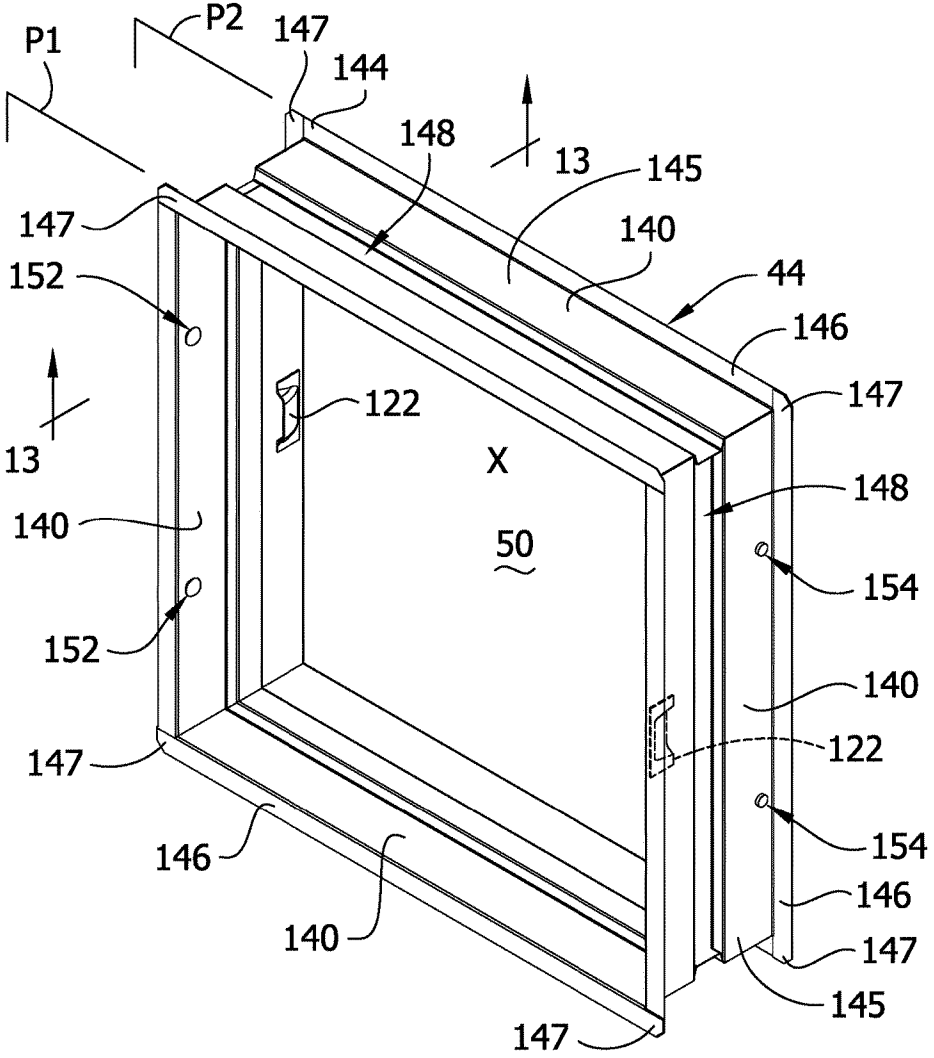
FIG. 12 is a perspective of a door frame of the assembly of FIG. 11.

FIGS. 11A and 11B illustrate a corner construction of the frame 44 at an intersection between the top frame member 140 and a side frame members 140. The rib 148 of the top frame member 140 is received in a notch 149 of complementary shape in the rib 148 of the vertical frame member. Desirably, the notch 149 has a depth substantially the same as the depth of the rib 148 in the top frame member 140, such that the web 145 and rib 148 of the top frame member bear against respective upper edges of the web 145 and rib 148 of the side frame member. As a result, a load on the top frame member 140 is distributed over substantially the entire webs 142 and ribs 148 of the two side frame members for efficient load transfer and overall increased strength of the frame. The corner construction of the frame 44 at the intersections between the bottom frame member 140 and the side frame members 140 is substantially identical to the corner construction described above at the intersections between the top frame member 140 and the side frame members 140. In the illustrated corner constructions, the webs 145 of the top and bottom frame members 140 are not welded to the webs 145 of the side frame members 140. Alternatively, the webs 145 of the frame members 140 can be welded together.

Desirably, the mine door 46 and mine door frame 44 described above are equipped to have the reversibility feature described earlier, that is, a feature which permits the mine door to be selectively mounted at the first side 142 of the door frame and then, as needed or desired, to be removed and re-mounted at the second opposite side 144 of the door frame, and vice versa. This feature is described in detail below.

Referring to FIGS. 11-15, the mine door 46 comprises at least one spring-loaded hinge, generally designated 150. Relatedly, the mine door frame 44 comprises at least one first fastener, generally designated 152, adjacent the first side 142 of the mine door frame and at least one second fastener, generally designated 154, adjacent the second opposite side of the mine door frame. In the illustrated embodiment, the mine door comprises two spring-loaded hinges 150, and the mine door frame comprises two first fasteners 152 and two second fasteners 154, although it will be understood that these numbers may vary. The spring-loaded hinges 150 are configured for releasable connection to the first fasteners 152 for selectively mounting the mine door 46 on the mine door frame in a first position (FIG. 11) at the first (front) side 142 of the mine door frame 44 for opening the door in a first direction indicated by the arrow 156, and for releasable connection to the second fasteners 154 for selectively mounting the mine door on the mine door frame in a second position (FIG. 22) at the second side 144 of the mine door frame 44 for opening the door in a second direction opposite the first direction and indicated by the arrow 158 in FIG. 11.

Figure 13:
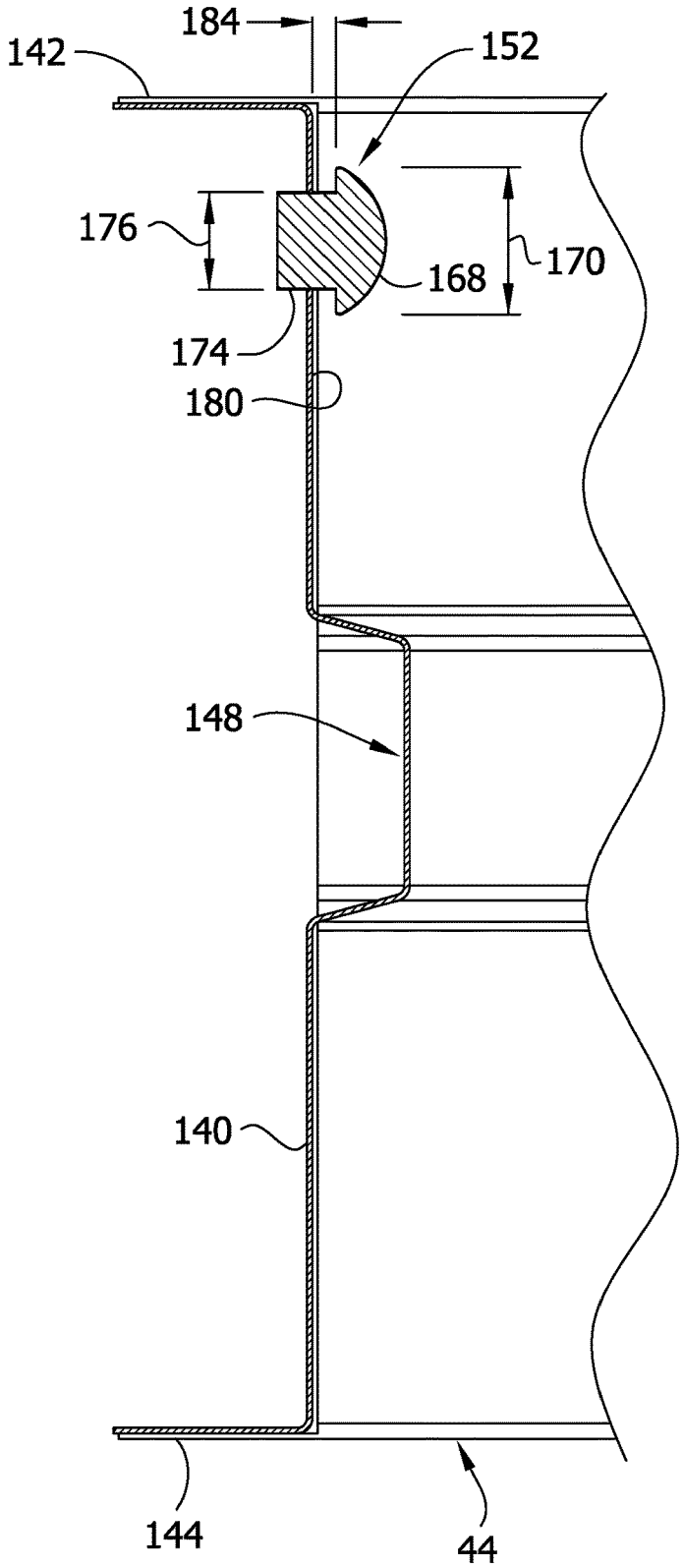
FIG. 13 is a section taken in the plane of 13-13 of FIG. 12.

Referring to FIG. 13, each of the first and second fasteners 152, 154 is a rivet-type fastener comprising a head 168 having a first dimension 170 (diameter) and a shank 174 extending from the head having a second dimension 176 (diameter) less than the first dimension. The shank is secured to the frame 44, as by welding, such that the head 168 of the fastener 152, 154 is spaced from an adjacent frame surface 180 to provide a relatively small gap 184 between the surface and the head. Other types of first and second fasteners can be used.

Figure 14:
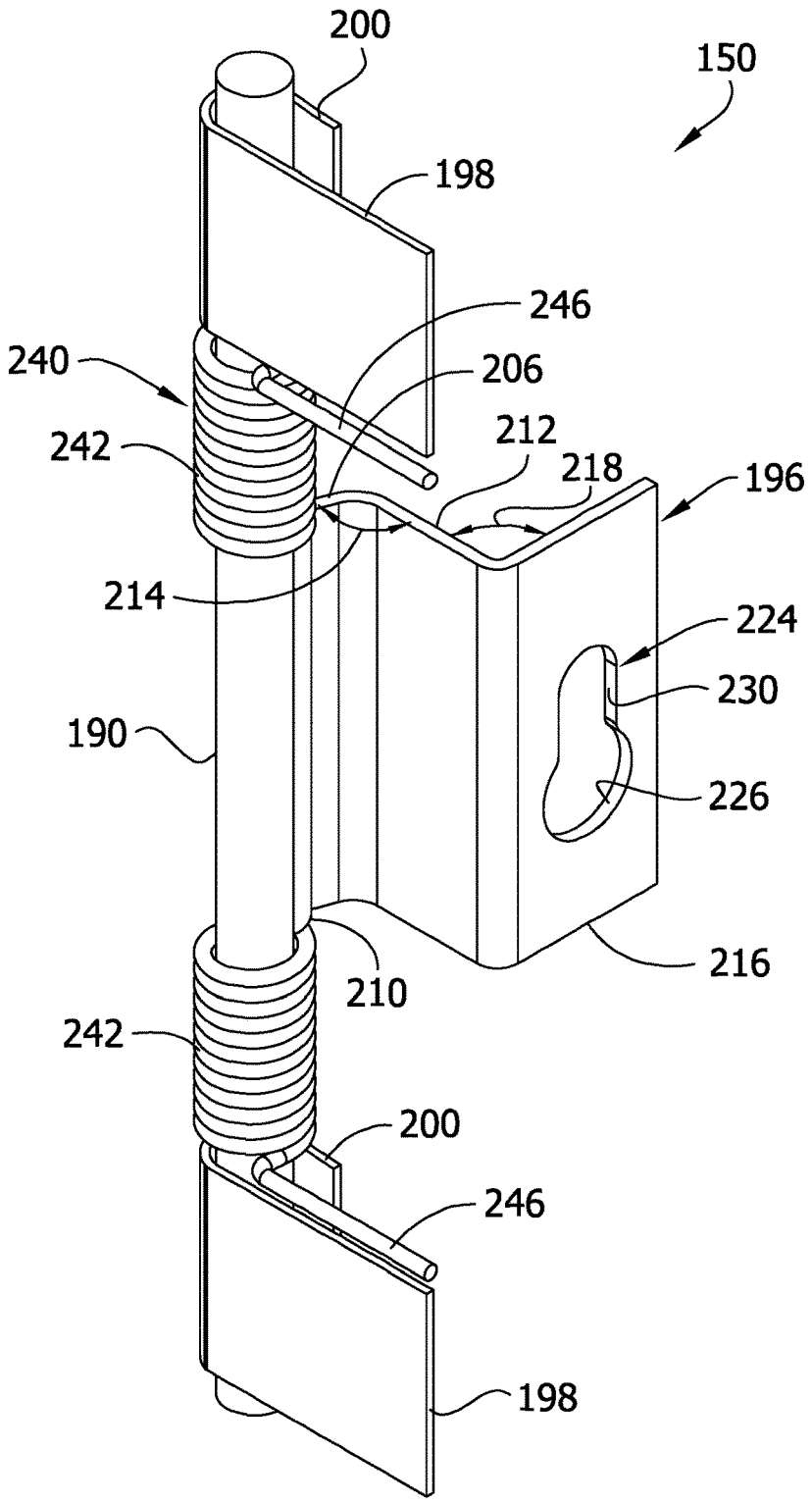
FIG. 14 is a perspective of a spring-loaded hinge of the assembly of FIG. 11.
Figure 15:
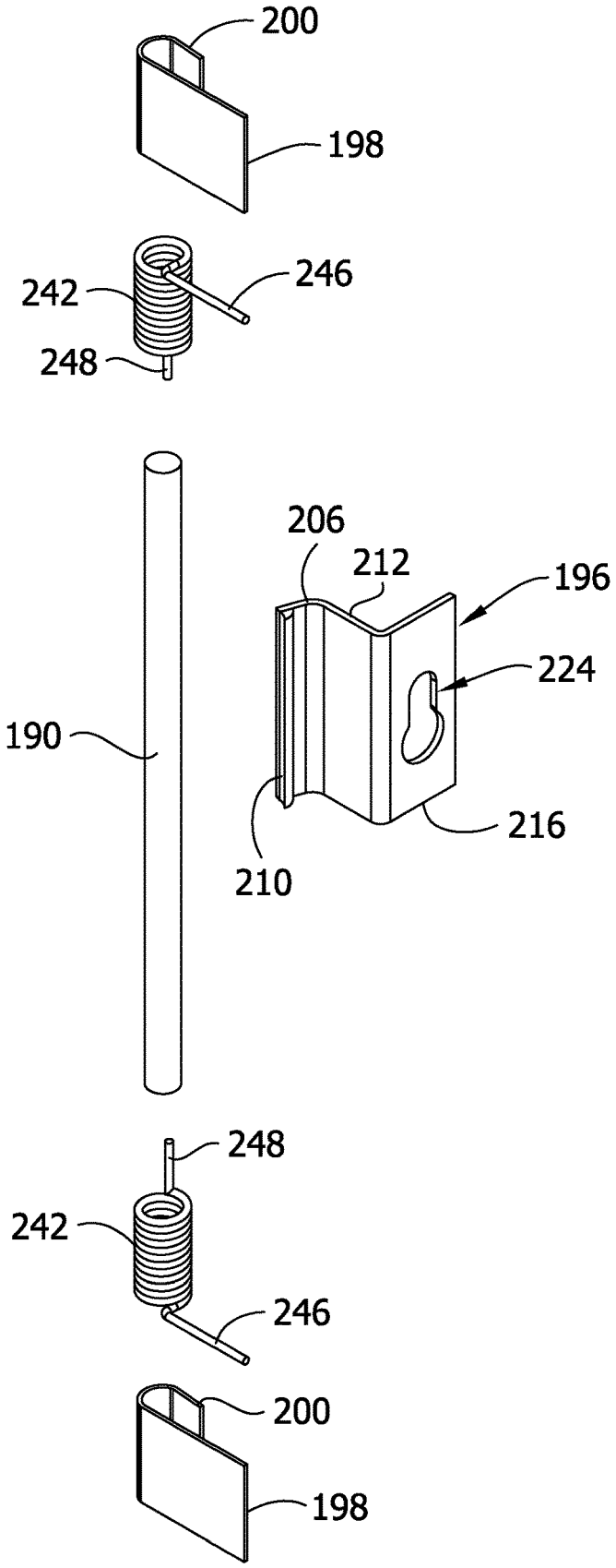
FIG. 15 is an exploded perspective of the components of the spring-loaded hinge of FIG. 14.

Referring to FIGS. 14 and 15, each spring-loaded hinge 150 comprises a bracket 196 configured for releasable attachment to a respective fastener 152, 154 on the door frame, a hinge pin 190 affixed in a non-rotatable manner (e.g., welded) to the bracket, and upper and lower hinge plates 198 connecting the mine door panel 52 to the hinge pin 190. In the illustrated embodiment, the hinge plates 198 are metal straps affixed in a non-rotatable manner (e.g., welded) to the outer face 62 of the door panel 52 and have vertically aligned arcuate (e.g., circular or part-circular) pin-receiving sections 200 that receive the hinge pin 190 and allow rotation of the hinge plates relative to the hinge pin so that the door panel 52 may be opened and closed about the longitudinal (vertical) axis of the hinge pin. In other embodiments, the spring-loaded hinge 150 may include more or less than two hinge plates 198. Hinge plates having configurations other than the one illustrated may also be used.

Figure 18:
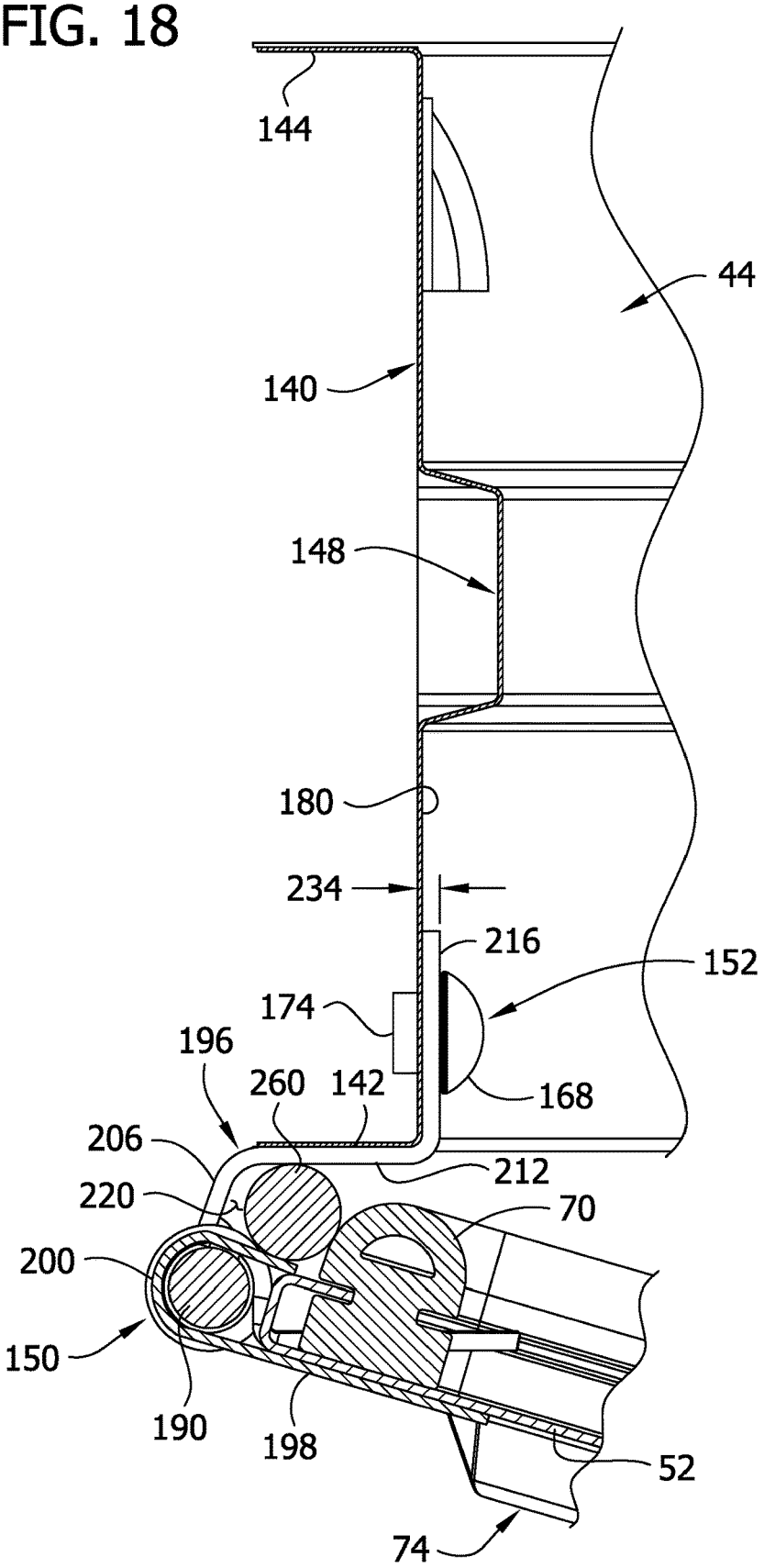
FIG. 18 is a section taken in the plane of 18-18 of FIG. 17.

Referring to FIGS. 14 and 15, the bracket 196 is generally Z-shaped and comprises a pin-attachment section 206 having a seat 210 in which the hinge pin 190 is seated and secured, as by welding, an intermediate section 212 extending at an angle 214 (e.g., an oblique angle) from the pin-attachment section, and a fastener section 216 extending at an angle 218 (e.g., substantially perpendicular) to the intermediate section. The bracket 196 may have other shapes. When the bracket 196 is fastened to the door frame 44, as illustrated in FIG. 18, the fastener section 216 extends in a plane generally parallel to the frame surface 180; the intermediate section 212 extends substantially parallel to a respective side 142 of the door frame; and the pin-attachment section 206 extends generally laterally outward away from the door frame. As is apparent from FIG. 18, the orientation of the door panel 52 relative to the bracket 196 changes as the door is opened and closed. As the door opens, movement of the door panel 52 relative to the bracket 196 creates a widening gap 220 between the intermediate section 212 of the bracket and pin-receiving section 200 of the hinge plate 198. Conversely, as the door closes, this gap 220 narrows, the significance of which will become apparent. The bracket may have other configurations within the scope of this invention.

Referring again to FIGS. 14 and 15, the fastener section 216 of the hinge bracket 196 has at least one fastener opening 224. In this embodiment, the fastener opening 224 is a keyhole slot having a first relatively wide region 226 sized to allow passage of the head 168 of a respective fastener 152, 154 and a second narrower region 230 sized to allow passage of the fastener shank 174 but not the fastener head. The thickness 234 of the fastener section 216 (FIG. 18) is slightly less than the size of the gap 184 (FIG. 13) between the fastener head 168 and the adjacent surface 180 of the mine door frame 44 to allow a portion of the bracket 196 around the keyhole slot 224 to move into the gap as the mine door is installed on the mine door frame, as described below.

Each spring-loaded hinge 150 also includes a spring mechanism, generally designated 240 in FIG. 14, for urging the mine door toward a closed position when the mine door 46 is mounted on the mine door frame 44 in its stated first and second positions. In the embodiment illustrated in FIGS. 14 and 15, the spring mechanism 240 comprises a pair of coil torsion springs 242 surrounding the hinge pin at positions adjacent the upper and lower hinge plates 198 of the hinge 150. The upper coil spring 242 is positioned between the upper hinge plate 198 and the top of the bracket 196, and the lower coil spring 242 is positioned between the lower hinge plate 198 and the bottom of the bracket 196. Alternatively, for lighter doors, only one spring 242 may be necessary. Each coil spring 242 terminates at one end in a first leg 246 bearing against the outer face 62 of the door panel 52 and terminates at an opposite end in a second leg 248 bearing against the pin-attachment section 206 of the bracket 196. The arrangement is such that when the mine door 46 is attached to the frame 44, the coils springs 242 urge the door toward a closed position. When the door is removed from the door frame, the springs 242 urge the bracket 196 toward a position corresponding to the position the bracket assumes when the mine door is in a closed position on the mine door frame. Other spring mechanisms can be used within the scope of this invention.

To mount the mine door 46 of the illustrated embodiment at one side of the door frame 44, e.g., the first side 142, the door is manipulated to establish releasable connections between the hinge brackets 196 and the first fasteners 152 at that side 142 of the door frame. This is accomplished by passing the heads 168 of the fasteners 152 on the door frame 44 through the wide regions 226 of the keyhole slots 224 in respective hinge brackets 196 to an initial position in which the fasteners are adjacent the lower ends of the slots. The door is then manipulated (lowered in the illustrated embodiment) to move the fastener shanks 174 up into the narrower regions 230 of respective slots 224 to a final position (FIG. 11) in which the fasteners are adjacent upper ends of respective slots. With the fasteners 142 in their final positions, the door is secured to the door frame for swinging between open and closed positions about the generally vertical axes of the hinge pins 190. The mine door is urged toward its closed position by the torsion springs 242. The door is latched closed by the latch mechanism 120.

Figure 16:
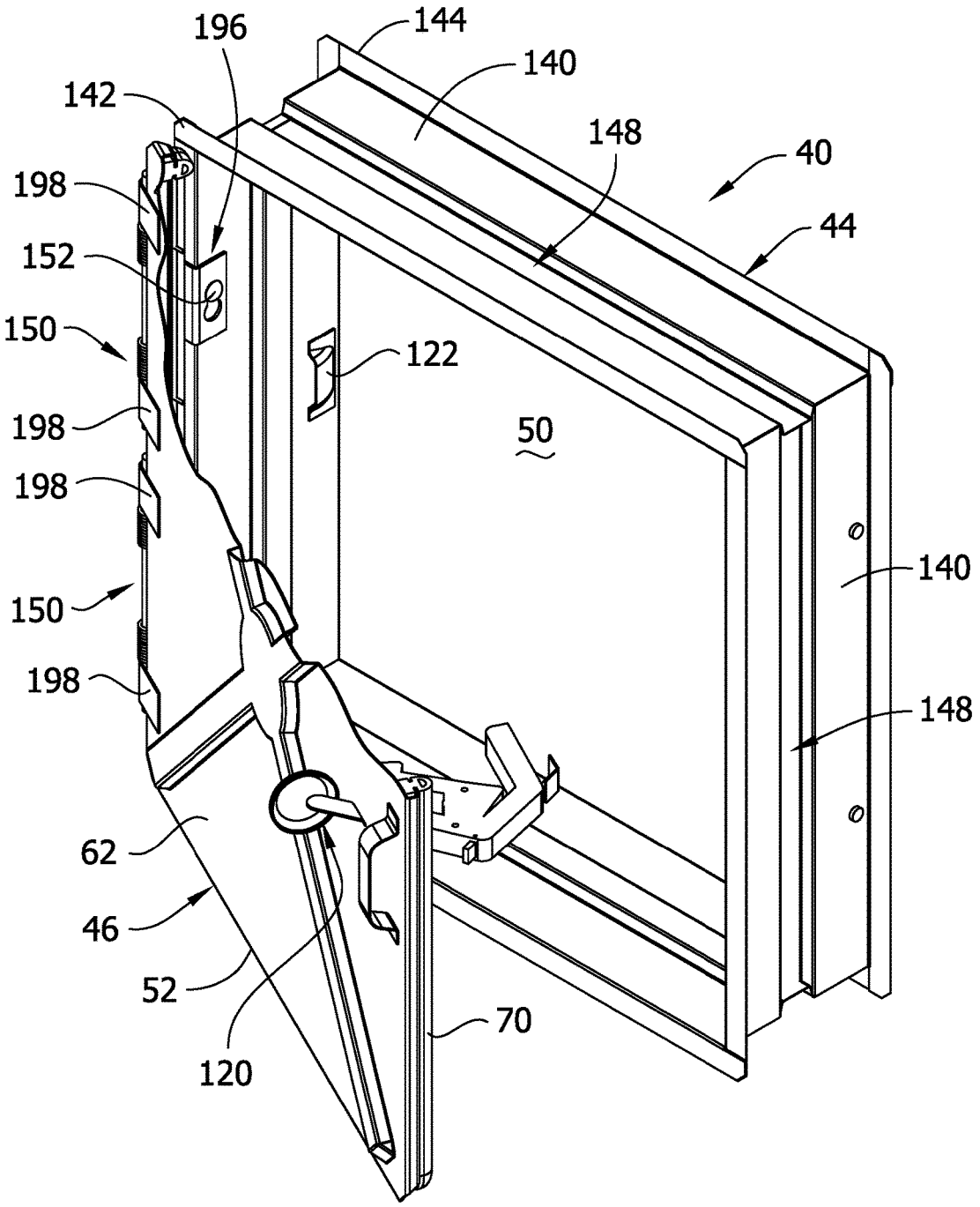
FIG. 16 is a perspective similar to FIG. 11 but showing the mine door in a partially open position.
Figure 17:
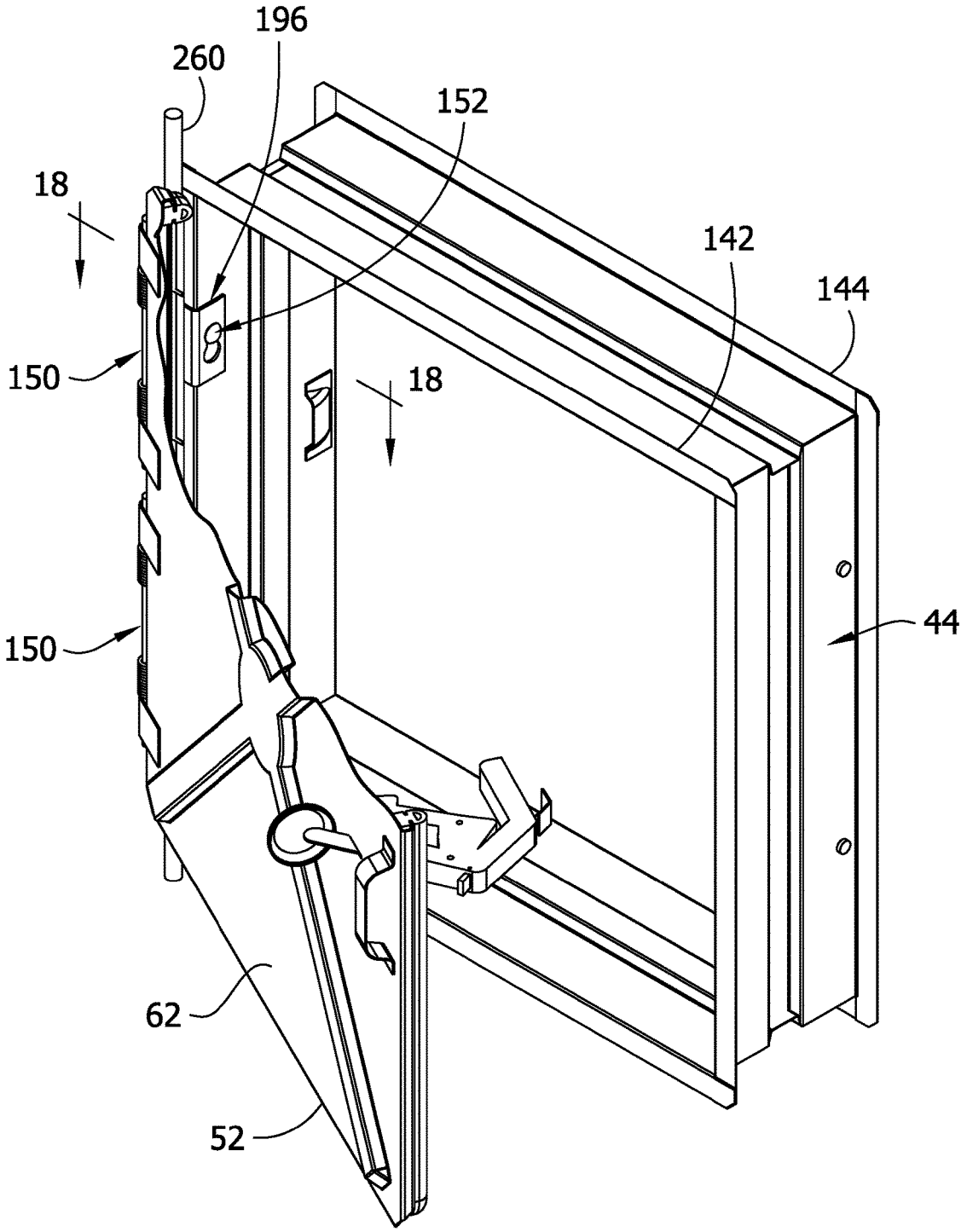
FIG. 17 is a view similar to FIG. 16 but showing the door held in the partially open position by a blocking device.
Figure 19:
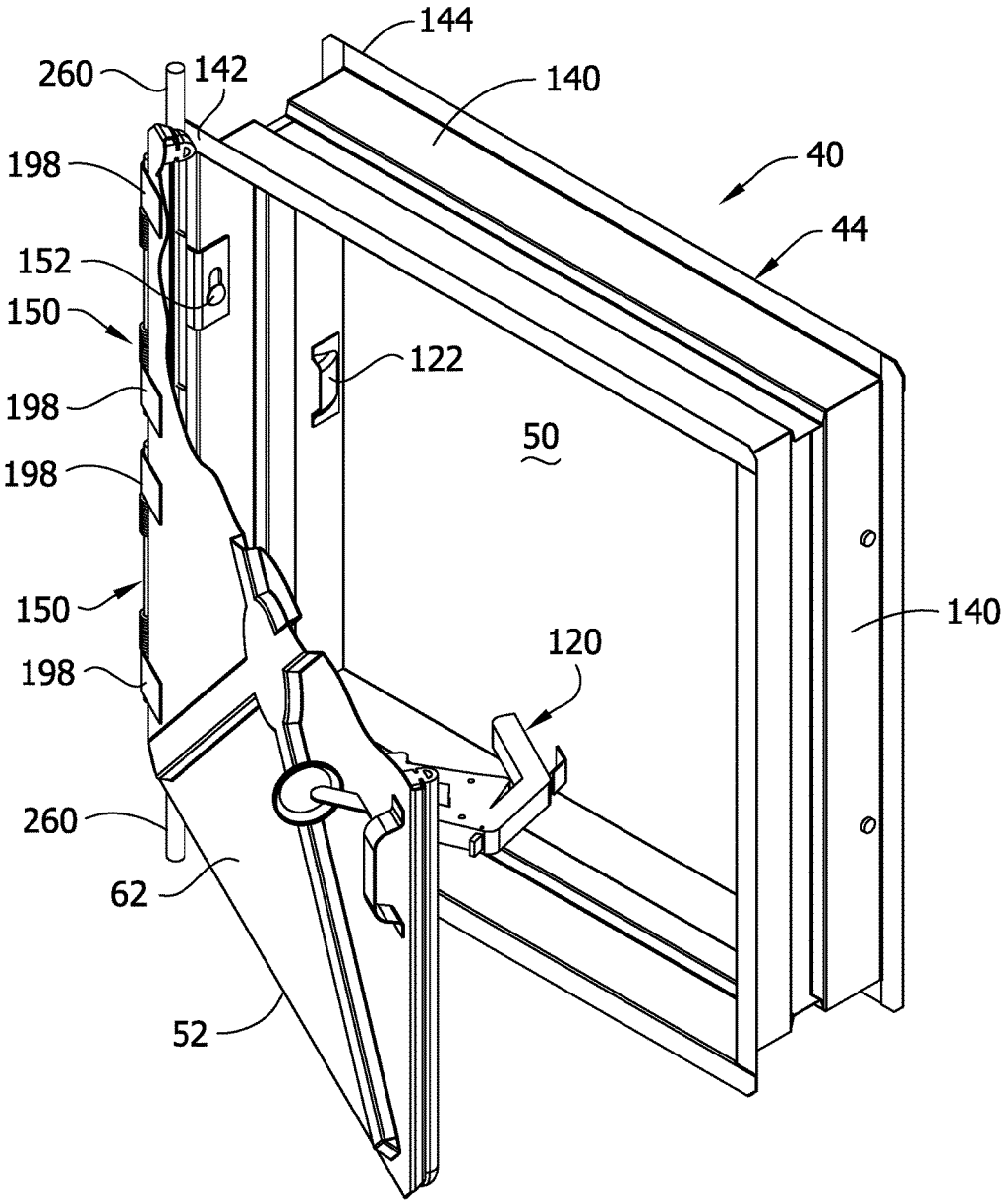
FIGS. 19-22 are views similar to FIG. 17 illustrating removal of the mine door from one side of a door frame prior to reinstallation of the door at an opposite side of the door frame.
Figure 20:
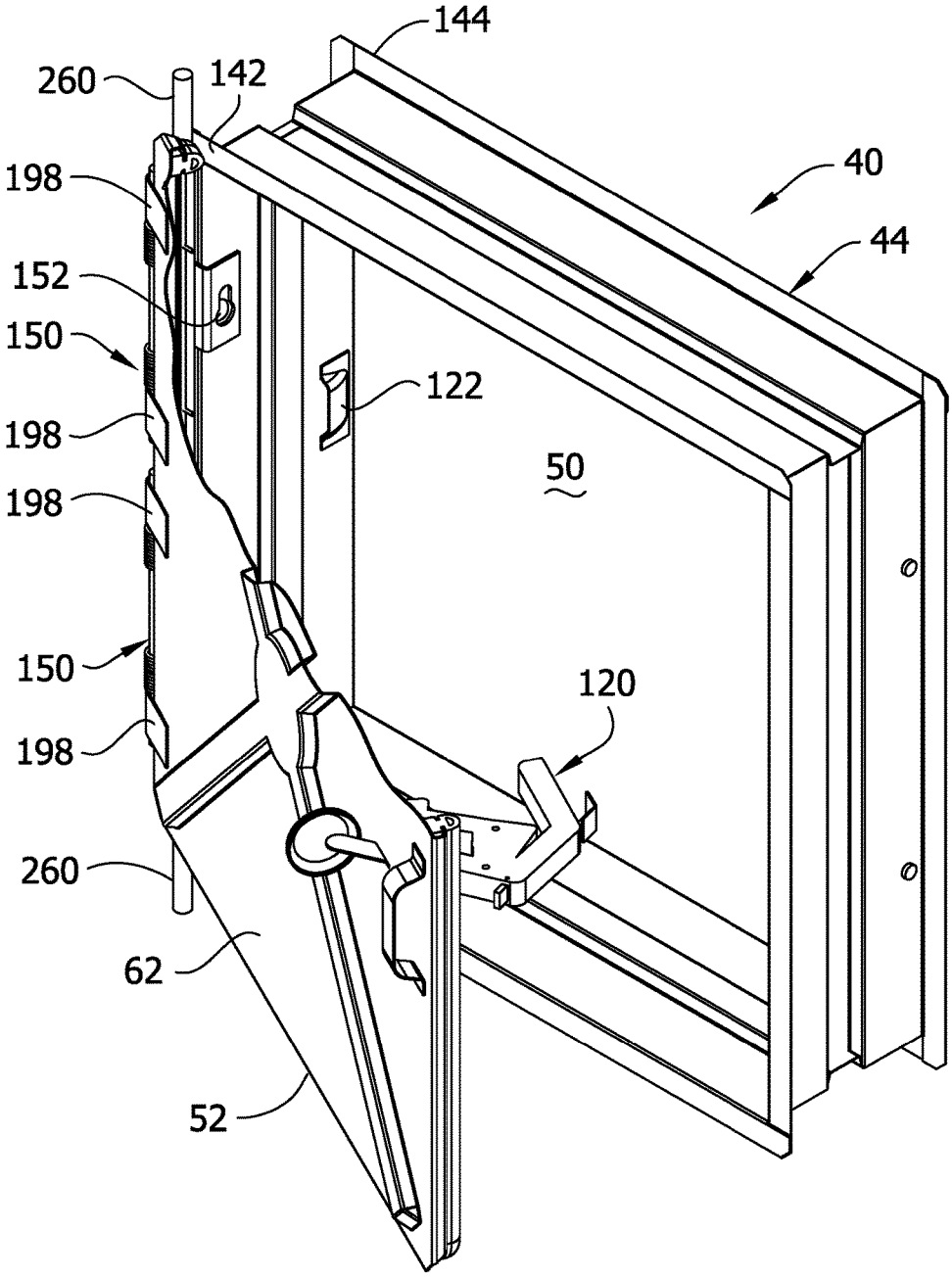
Figure 21:
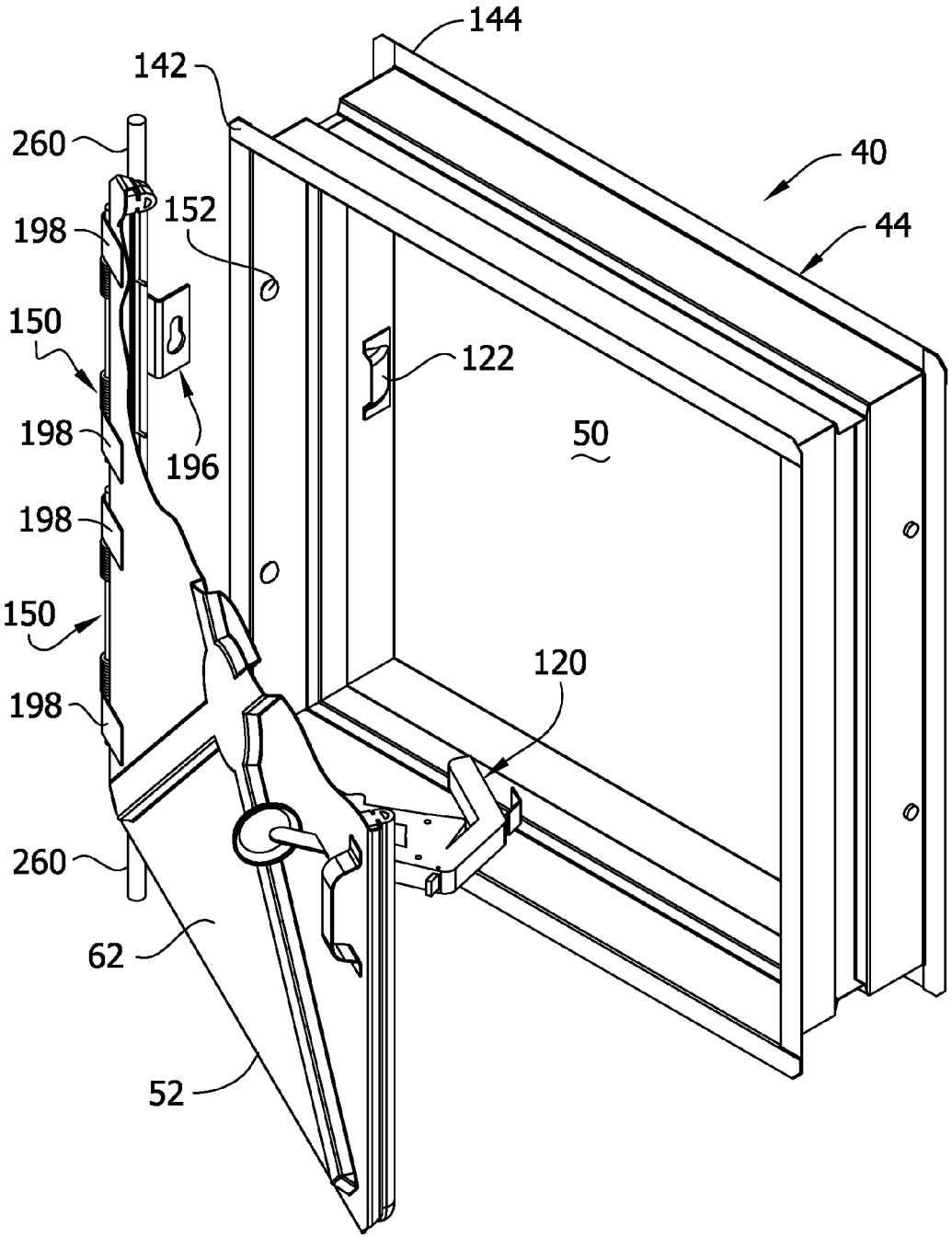
Figure 22:
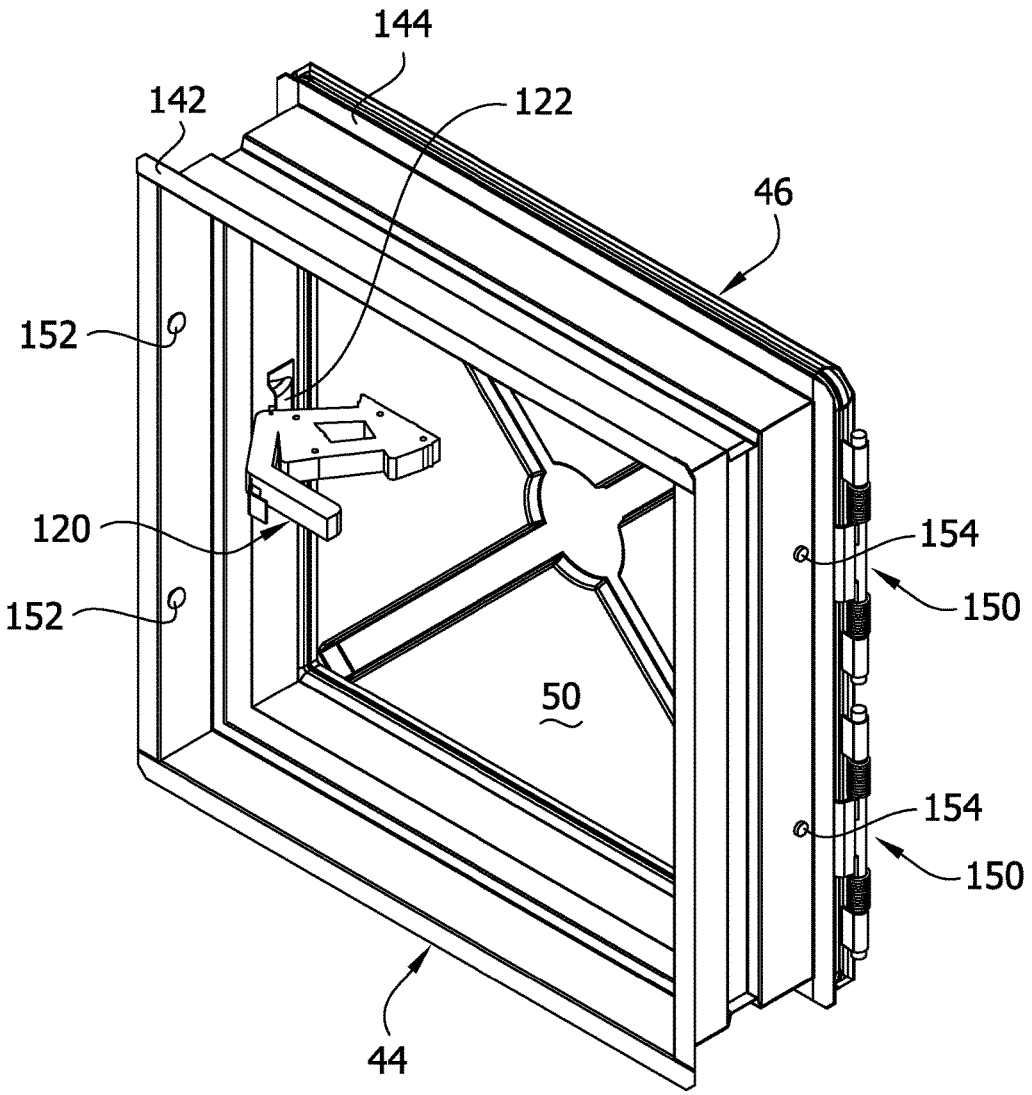

The releasable connections between the mine door 46 and mine door frame 44 allow the mine door to be quickly and easily moved from one side 142 of the door frame to the opposite side 144 of the door frame. To remove the mine door 46 from the first side 142 of the door frame 44, the door is unlatched and moved to a partially or fully open position (see FIG. 16) against the urging of the spring mechanism 240. The door is maintained in this open position by placing a blocking device 260, e.g., a long rod or other suitable object or objects, into the gaps 220 between the hinge plates 198 attached to the door panel 52 and the intermediate sections 212 of the brackets 196 attached to the door frame 44 (see FIGS. 17 and 18). The mine door is then lifted up to a position in which the heads 168 of the fasteners 152 are aligned with the wide regions 226 of respective keyhole slots 224 (FIG. 19), at which point the mine door can be removed from the door frame (FIG. 20). When the door is removed (FIG. 21), the blocking device 260 maintains the brackets 196 of the spring-loaded hinges 150 in a fixed orientation relative to the mine door panel 52 against the urging of the coil springs 242, thus facilitating reinstallation of the door at the opposite side 144 of the door frame 44 (FIG. 22). The mine door 46 is reinstalled using the same process described above except that the second fasteners 154 on the second opposite side 144 of the frame 44 are used for establishing the releasable connections. After the mine door has been reinstalled, the blocking device 260 is removed from the gaps 220 and the door closes under the urging of the spring mechanism 240. The latch 120 is used to secure the door in its closed position. It will be understood in this regard that the frame 44 is equipped with two keepers 122, a first keeper adjacent the first side 142 of the frame for use when the door is installed at that side of the frame, and a second keeper adjacent the second side 144 of the frame for use when the door is installed at that side of the frame.

Having described the invention in detail, it will be apparent that modifications and variations are possible without departing from the scope of the invention defined in the appended claims. By way of example but not limitation, the mine door described above has both the reinforcing (e.g., X-shaped) feature and the reversibility feature. In other embodiments, a mine door of this invention may have the reversibility feature but not the reinforcing feature. Conversely, a mine door of this invention can have the reinforcing structure but not the reversibility feature.

The reversibility feature can be claimed in various ways, including but not limited to the following 1. A mine door assembly for installation in a mine passageway, the mine door assembly comprising a mine door frame having a first side facing a first direction and a second side facing a second direction opposite the first direction, a mine door comprising at least one spring-loaded hinge for mounting the mine door on the mine door frame and urging the mine door toward a closed position, said spring-loaded hinge comprising a bracket, at least one first fastener on the mine door frame adjacent the first side of the mine door frame, at least one second fastener on the mine door frame adjacent the second side of the mine door frame, wherein the bracket of the at least one spring-loaded hinge is configured for releasable connection to the at least one first fastener for selectively mounting the mine door on the mine door frame in a first position at the first side of the mine door frame for opening the door in said first direction, and for releasable connection to the at least one second fastener for selectively mounting the mine door on the mine door frame in a second position at the second side of the mine door frame for opening the door in said second direction.

2. The mine door assembly of claim 1, wherein the at least one spring-loaded hinge further comprises a hinge pin connected to the bracket, and at least one hinge plate connecting the mine door to the hinge pin.

3. The mine door assembly of claim 2, wherein the at least one hinge plate is affixed to an outer face of the mine door and comprises an arcuate pin-receiving section that receives the hinge pin and allows rotation of the at least one hinge plate and mine door about a longitudinal axis of the hinge pin.

4. The mine door assembly of claim 2, wherein the bracket comprises a pin-attachment section affixed to the hinge pin, an intermediate section extending at an angle from the pin-attachment section, and a fastener section extending at an angle from the intermediate section, the fastener section having at least one fastener opening for receiving the at least one first fastener when the mine door is mounted on the mine door frame in said first position and for receiving the at least one second fastener when the mine door is mounted on the mine door frame in said second position.

5. The mine door assembly of claim 4, wherein the at least one spring-loaded hinge is configured for creating a gap between the intermediate section of the bracket and the at least one hinge plate, said gap widening when the door is opened for receiving a blocking device to maintain the size of the gap when the mine door is removed from the mine door frame.

6. The mine door assembly of claim 2, wherein the bracket comprises a pin-attachment section affixed to the hinge pin and a fastener section, wherein each fastener of the at least one first fastener and at least one second fastener comprises a shank secured to the door frame and a head spaced from the door frame, and wherein the fastener section of the bracket has at least one fastener opening comprising a keyhole slot for receiving a respective first or second fastener.

7. A mine door comprising a mine door panel having a first side adapted to face a first direction and a second side adapted to face a second direction opposite the first direction, at least one spring-loaded hinge on the mine door panel for mounting the mine door panel on a mine door frame and urging the mine door panel toward a closed position, said at least one spring-loaded hinge comprising a bracket configured for releasable connection to at least one first fastener on said mine door frame for selectively mounting the mine door on the mine door frame in a first position at the first side of the mine door frame for opening the mine door in said first direction, and for releasable connection to at least one second fastener for selectively mounting the mine door on the mine door frame in a second position at the second side of the mine door frame for opening the mine door in said second direction.

8. The mine door of claim 7, wherein the at least one spring-loaded hinge further comprises a hinge pin connected to the bracket, and at least one hinge plate connecting the mine door panel to the hinge pin.

9. The mine door of claim 9, wherein the at least one hinge plate is affixed to an outer face of the mine door panel and comprises an arcuate pin-receiving section that receives the hinge pin and allows rotation of the at least one hinge plate and mine door about a longitudinal axis of the hinge pin.

10. The mine door of claim 8, wherein the bracket comprises a pin-attachment section affixed to the hinge pin, an intermediate section extending at an angle from the pin-attachment section, and a fastener section extending at an angle from the intermediate section, the fastener section having at least one fastener opening for receiving the at least one first fastener when the mine door is mounted on the mine door frame in said first position and for receiving the at least one second fastener when the mine door is mounted on the mine door frame in said second position.

11. The mine door of claim 10, wherein the at least one spring-loaded hinge is configured for creating a gap between the intermediate section of the bracket and the at least one hinge plate, said gap widening when the mine door is opened for receiving a blocking device to maintain the size of the gap when the mine door is removed from the mine door frame.

12. The mine door of claim 8, wherein the bracket comprises a pin-attachment section affixed to the hinge pin and a fastener section, wherein each fastener of the at least one first fastener and at least one second fastener comprises a shank secured to the mine door frame and a head spaced from the mine door frame, and wherein the fastener section of the bracket has at least one fastener opening comprising a keyhole slot for receiving a respective first or second fastener.

13. A mine door assembly for installation in a mine passageway, the mine door assembly comprising a mine door frame having a first side adapted to face a first direction and a second side adapted to face a second direction opposite the first direction, a mine door comprising at least one hinge for mounting the mine door on the mine door frame, said hinge comprising at least one bracket having a keyhole slot, at least one first fastener on the mine door frame adjacent the first side of the mine door frame, at least one second fastener on the mine door frame adjacent the second side of the mine door frame, wherein the keyhole slot is adapted to receive the at least one first fastener for selectively and releasably mounting the mine door in a first position on the mine door frame for opening the door in said first direction, and wherein the keyhole slot is adapted to receive the at least one second fastener for selectively and releasably mounting the mine door in a second position on the mine door frame for opening the door in said second direction.

When introducing elements of the present invention or the preferred embodiments(s) thereof, the articles "a", "an", the and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and products without departing from the scope of the invention, it is intended that all matter contained in the above description and shown in the accompanying drawings shall be interpreted as illustrative and not in a limiting sense.

What is claimed is:

1. A reinforced lightweight mine door for installation in a mine passageway, the mine door comprising a generally rectangular sheet metal door panel having four sides and four corners, a reinforcing structure projecting from a face of the door panel, said reinforcing structure comprising a central section and a plurality of channel sections extending from the central section toward respective sides or corners of the door panel, the plurality of channel sections including at least three channel sections that radiate from the central section in different directions toward the respective sides or corners of the door panel, at least one flat hinge area on the door panel immediately adjacent a hinge side of the door panel, said door panel being free of reinforcement connecting said channel sections and said at least one flat hinge area, at least one hinge mounted on the at least one flat hinge area, and wherein each channel section has a length extending from the central section to a distal end of the channel section and opposite sides extending along the length, the distal end and the opposite sides of each channel section projecting from the face of the door panel;

wherein at least two of the plurality of channel sections comprises a hinge side channel section that extends between the central section and the hinge side of the door panel;

wherein the opposite sides of each hinge side channel section terminate at the distal end of the respective hinge side channel section; and wherein the distal end of each hinge side channel section is located adjacent to the hinge side of the door panel and is spaced apart from the hinge side of the door panel.

2. The mine door of claim 1, wherein the mine door lacks a second door panel sandwiching the reinforcing structure between said sheet metal door panel and said second door panel.

3. The mine door of claim 1, wherein the at least some of the channel sections extend toward respective corners of the door panel and have distal ends terminating short of respective corners of the door panel to provide flat corner sections of the door panel.

4. The mine door of claim 3, wherein the door panel comprises a flat sealing area around a periphery of the door panel, said sealing area including said flat corner sections, and a seal in the sealing area for engagement with a door frame.

5. The mine door of claim 1, wherein the central section is a generally dish-shaped formation projecting from the face of the door panel a first distance corresponding to a depth of the central section.

6. The mine door of claim 5, wherein each channel section further comprises a bottom wall extending between the opposite sides of the channel section and spaced a second distance from the face of the door panel corresponding to a depth of the channel section.

7. The mine door of claim 6, wherein the central section is generally circular or oval, and wherein the channel sections have proximal ends intersecting the side wall of the central section at intervals around the central section.

8. The mine door of claim 7, wherein the bottom wall of each channel section has a width dimension, and wherein the bottom wall of the central section has a cross-dimension greater than said width dimension.

9. The mine door of claim 8, wherein the width dimension of each channel section is at least twice said second distance.

10. The mine door of claim 8, wherein the cross-dimension of the bottom wall of the central section is greater than the sum of the width dimensions of the bottom walls of the channel sections.

11. The mine door of claim 6, wherein the first and second distances are substantially equal.

12. The mine door of claim 6, further comprising corrugations in the bottom wall of the central section and in the bottom walls of the channel sections generally adjacent intersections of the channel sections and the central section.

13. The mine door of claim 1, wherein said reinforcing structure is formed as one piece from the sheet metal of the door panel.

14. The mine door of claim 1, wherein said reinforcing structure is generally X shaped and two of said channel sections terminate short of two respective corners of the door panel, wherein said at least one flat hinge area comprises two flat hinge areas immediately adjacent said respective corners, wherein said at least one hinge comprises two hinges mounted on said two flat hinge areas, and wherein said door panel is free of any reinforcement connecting said channel sections and said two flat hinge areas.

15. The mine door of claim 1, wherein said face of the door panel is a first face of the door panel, and wherein the mine door further comprises a seal on a second face of the door panel opposite the first face for sealing engagement with a door frame.

16. The mine door of claim 1, as installed in the mine passageway.

17. The mine door of claim 1, in combination with a door frame comprising a horizontal top frame member, a horizontal bottom frame member, and left and right vertical side frame members, each frame member comprising a web and at least one flange extending from the web, and at least the top frame member having a reinforcing rib extending lengthwise of the frame member along the web of the frame member, and wherein the frame has a corner construction in which the reinforcing rib of the top frame member is received in a notch in one of the side frame members such that the web and reinforcing rib of the top frame member bear against the web and rib, respectively, of the one side frame member.

18. A mine door assembly for installation in a mine passageway, the mine door assembly comprising a mine door frame defining a doorway, the doorway having opposite first and second ends spaced apart along a thickness of the doorway, opposite first and second sides spaced apart along a width of the doorway, and a top and a bottom spaced apart along a height of the doorway, the mine door frame comprising a first side portion defining at least the first side of the doorway and a second side portion defining at least the second side of the doorway, the mine door frame having a first face lying generally in a first plane at the first end of the doorway and facing outwardly away from the mine door frame in a first direction and a second face lying generally in a second plane at the second end of the doorway and facing outwardly away from the mine door frame in a second direction opposite the first direction, the first and second faces of the mine door frame being spaced apart along the thickness of the doorway, a mine door comprising at least one spring-loaded hinge for mounting the mine door on the mine door frame and urging the mine door toward a closed position, said spring-loaded hinge comprising a bracket, at least one first fastener on the first side portion of the mine door frame adjacent the first face of the mine door frame, at least one second fastener on the second side portion of the mine door frame adjacent the second face of the mine door frame, wherein the bracket of the at least one spring-loaded hinge is mountable on the at least one first fastener on the first side portion of the mine door frame to selectively establish a first releasable connection with the mine door frame and wherein the bracket of the at least one spring-loaded hinge is mountable on the at least one second fastener on the second side portion of the mine door frame to selectively establish a second releasable connection with the mine door fame, wherein the first releasable connection mounts the mine door on the mine door frame in a first position at the first face of the mine door frame and wherein the mine door is openable by swinging on the at least one spring-loaded hinge away from the first face of the mine door frame in said first direction when the mine door is connected to the mine door frame by the first releasable connection, wherein the second releasable connection mounts the mine door on the mine door frame in a second position at the second face of the mine door frame and wherein the mine door is openable by swinging on the at least one spring-loaded hinge away from the second face of the mine door frame in said second direction when the mine door is connected to the mine door frame by the second releasable connection.

19. A mine door assembly as set forth in claim 18, wherein:

the bracket of the at least one spring-loaded hinge is removable from the at least one first fastener to release the first releasable connection and disconnect the mine door from the mine door frame without separating the first fastener from the mine door frame or separating the at least one spring loaded hinge from the mine door, and the bracket of the at least one spring-loaded hinge is removable from the at least one second fastener to release the second releasable connection and disconnect the mine door from the mine door frame without separating the second fastener from the mine door frame or separating the at least one spring loaded hinge from the mine door.

20. A mine door assembly for installation in a mine passageway, the mine door assembly comprising a mine door frame defining a doorway, the doorway having opposite first and second ends spaced apart along a thickness of the doorway, opposite first and second sides spaced apart along a width of the doorway, and a top and a bottom spaced apart along a height of the doorway, the mine door frame comprising a first side portion defining at least the first side of the doorway and a second side portion defining at least the second side of the doorway, the mine door frame having a first face lying generally in a first plane at the first end of the doorway and facing outwardly away from the mine door frame in a first direction and a second face lying generally in a second plane at the second end of the doorway and facing outwardly away from the mine door frame in a second direction opposite the first direction, the first and second faces of the mine door frame being spaced apart along the thickness of the doorway, a mine door comprising at least one hinge for mounting the mine door on the mine door frame, said hinge comprising at least one bracket having a keyhole slot, at least one first fastener on the first side portion of the mine door frame adjacent the first face of the mine door frame, at least one second fastener on the second side portion of the mine door frame adjacent the second face of the mine door frame, wherein the keyhole slot is adapted to receive the at least one first fastener for selectively lockingly engaging the bracket with the fastener to establish a first releasable connection between the mine door and the mine door frame, the first releasable connection releasably mounting the mine door on the mine door frame in a first position at the first face of the mine door frame, wherein the mine door is openable by swinging on the at least one hinge away from the first face of the mine door frame in said first direction when the mine door is connected to the mine door frame by the first releasable connection, and wherein the keyhole slot is adapted to receive the at least one second fastener for selectively lockingly engaging the bracket with the fastener to establish a second releasable connection between the mine door and the mine door frame, the second releasable connection releasably mounting the mine door on the mine door frame in a second position at the second face of the mine door frame, wherein the mine door is openable by swinging on the at least one hinge away from the second face of the mine door frame in said second direction when the mine door is connected to the mine door frame by the second releasable connection.

* * * * *